US005802016A

United States Patent [19]

Kubota et al.

[11] Patent Number: 5,802,016

[45] Date of Patent: Sep. 1, 1998

[54] ELECTRONIC WATCH

[75] Inventors: Masaru Kubota; Takashi Kawaguchi; Hidehiro Akahane; Yoshitaka Iijima; Keiichiro Oguchi; Mikiko Ito; Youichi Hayashi; Hidenori Makiba, all of Suwa, Japan

[73] Assignee: Seiko Epson Corporation, Tokyo, Japan

[21] Appl. No.: 269,453

[22] Filed: Jun. 30, 1994

[30] Foreign Application Priority Data

| | | | |
|---|---|---|---|
| Jul. 1, 1993 | [JP] | Japan | 5-163650 |
| Dec. 14, 1993 | [JP] | Japan | 5-313643 |

[51] Int. Cl.[6] ..... G04B 47/06

[52] U.S. Cl. ..... 368/11

[58] Field of Search ..... 368/11, 10

[56] References Cited

U.S. PATENT DOCUMENTS

| | | | |
|---|---|---|---|
| 2,510,402 | 6/1950 | Johnston | 368/11 |
| 4,247,112 | 1/1981 | Hubner . | |
| 4,257,112 | 3/1981 | Hubner | 368/11 |
| 4,352,168 | 9/1982 | Anderson | 368/10 |
| 4,561,783 | 12/1985 | Iedemey | 368/309 |
| 4,783,772 | 11/1988 | Umemoto et al. | 368/11 |
| 5,224,059 | 6/1993 | Nitta et al. | 368/11 |
| 5,357,488 | 10/1994 | Udo et al. | 368/11 |

FOREIGN PATENT DOCUMENTS

| | | | |
|---|---|---|---|
| 0195 636 | 9/1986 | European Pat. Off. . | |
| 0195636 | 9/1986 | European Pat. Off. . | |
| 0 345 929 | 12/1989 | European Pat. Off. . | |
| 0345929 | 12/1989 | European Pat. Off. . | |
| 1248 | 1/1992 | European Pat. Off. | 368/11 |
| 0 500 386 | 8/1992 | European Pat. Off. . | |
| 0500386 | 8/1992 | European Pat. Off. . | |
| 1402908 | 3/1964 | France | 368/11 |
| 3603073 | 8/1986 | Germany . | |
| 53-127772 | 10/1978 | Japan . | |
| 58-135483 | 8/1983 | Japan . | |
| 601588 | 1/1985 | Japan . | |
| 63-75690 | 4/1988 | Japan . | |
| 2247594 | 10/1990 | Japan . | |

*Primary Examiner*—Bernard Roskoski
*Attorney, Agent, or Firm*—Eric B. Janofsky

[57] ABSTRACT

A multifunctional electronic watch of the present invention displays data measured by a built-in atmospheric pressure sensor by means of a small atmospheric pressure pointer and an atmospheric pressure pointer. It is also capable of displaying a differential between the present atmospheric pressure and an atmospheric pressure three hours before by means of an atmospheric pressure tendency pointer. A dial ring attached around a clockface of the watch is formed with an atmospheric pressure scale, on the outer periphery of which is a rotation bezel formed with a height scale. The built-in sensor is accommodated in the watch so as not to project from the rotation bezel of the watch. Accordingly, an electronic watch which has additional functions of indicating environmental data such as atmospheric pressure without complicating the constitution can be realized.

4 Claims, 25 Drawing Sheets

| ADDRESS | | |
|---|---|---|
| 00H | SECOND COUNTER | 601 |
| 02H | HOUR AND MINUTE COUNTER | 602 |
| 05H | ATMOSPHERIC PRESSURE | 603 |
| 08H | ATMOSPHERIC PRESSURE POINTER POSITION | 604 |
| 0BH | ATMOSPHERIC PRESSURE POINTER POSITION | 605 |
| 0EH | PRESENT POSITION OF ATMOSPHERIC POINTER | 606 |
| 11H | PRESENT POSITION OF SMALL ATMOSPHERIC POINTER | 607 |
| 14H | POINTER POSITION DIFFERENTIAL | 608 |
| 17H | SMALL POINTER POSITION DIFFERENTIAL | 609 |
| 1AH | ALARM SET TIME | 610 |
| 1DH | PRIOR ATMOSPHERIC PRESSURE | 611 |
| 20H | PRIOR ATMOSPHERIC PRESSURE DIFFERENTIAL | 612 |

FIG._14

| ADDRESS | | |
|---|---|---|
| 00H | SECOND COUNTER | 601 |
| 02H | HOUR AND MINUTE COUNTER | 602 |
| 05H | ATMOSPHERIC PRESSURE | 603 |
| 08H | ATMOSPHERIC PRESSURE POINTER POSITION | 604 |
| 0BH | ATMOSPHERIC PRESSURE POINTER POSITION | 605 |
| 0EH | PRESENT POSITION OF ATMOSPHERIC POINTER | 606 |
| 11H | PRESENT POSITION OF SMALL ATMOSPHERIC POINTER | 607 |
| 14H | POINTER POSITION DIFFERENTIAL | 608 |
| 17H | SMALL POINTER POSITION DIFFERENTIAL | 609 |
| 1AH | ALARM SET TIME | 610 |
| 1DH | PRIOR ATMOSPHERIC PRESSURE | 611 |
| 20H | PRIOR ATMOSPHERIC PRESSURE DIFFERENTIAL | 612 |
| 23H | LOWEST ATMOSPHERIC PRESSURE | 613 |
| 26H | PRESSURE CORRECTION MODE | 614 |
| 27H | BATTERY LIFE | 615 |

FIG._17

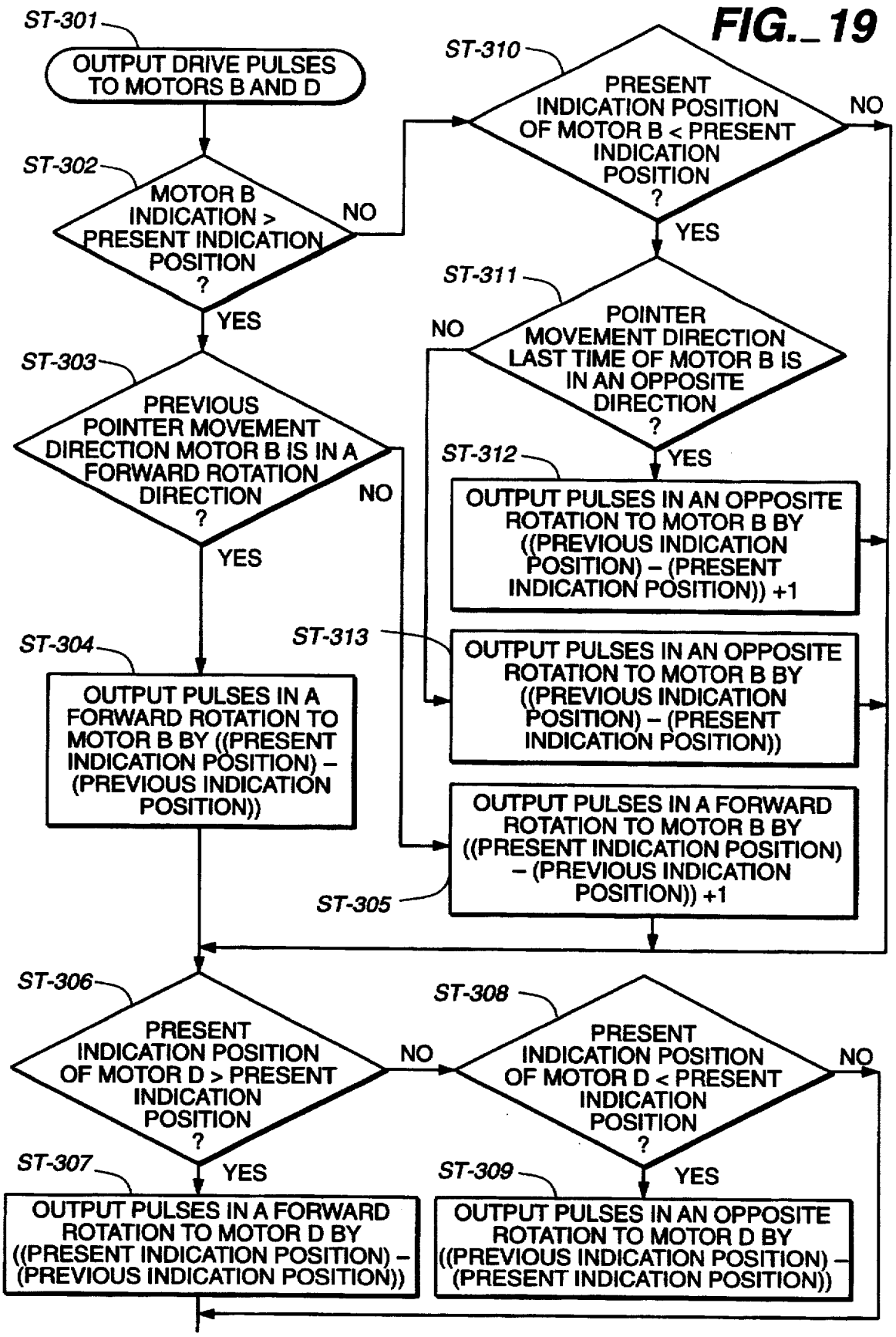
FIG._19
ST-301
OUTPUT DRIVE PULSES TO MOTORS B AND D
ST-302
MOTOR B INDICATION > PRESENT INDICATION POSITION ?
NO
YES
ST-303
PREVIOUS POINTER MOVEMENT DIRECTION MOTOR B IS IN A FORWARD ROTATION DIRECTION ?
NO
YES
ST-304
OUTPUT PULSES IN A FORWARD ROTATION TO MOTOR B BY ((PRESENT INDICATION POSITION) – (PREVIOUS INDICATION POSITION))
ST-310
PRESENT INDICATION POSITION OF MOTOR B < PRESENT INDICATION POSITION ?
NO
YES
ST-311
POINTER MOVEMENT DIRECTION LAST TIME OF MOTOR B IS IN AN OPPOSITE DIRECTION ?
NO
YES
ST-312
OUTPUT PULSES IN AN OPPOSITE ROTATION TO MOTOR B BY ((PREVIOUS INDICATION POSITION) – (PRESENT INDICATION POSITION)) +1
ST-313
OUTPUT PULSES IN AN OPPOSITE ROTATION TO MOTOR B BY ((PREVIOUS INDICATION POSITION) – (PRESENT INDICATION POSITION))
ST-305
OUTPUT PULSES IN A FORWARD ROTATION TO MOTOR B BY ((PRESENT INDICATION POSITION) – (PREVIOUS INDICATION POSITION)) +1
ST-306
PRESENT INDICATION POSITION OF MOTOR D > PRESENT INDICATION POSITION ?
NO
YES
ST-307
OUTPUT PULSES IN A FORWARD ROTATION TO MOTOR D BY ((PRESENT INDICATION POSITION) – (PREVIOUS INDICATION POSITION))
ST-308
PRESENT INDICATION POSITION OF MOTOR D < PRESENT INDICATION POSITION ?
NO
YES
ST-309
OUTPUT PULSES IN AN OPPOSITE ROTATION TO MOTOR D BY ((PREVIOUS INDICATION POSITION) – (PRESENT INDICATION POSITION))

ELECTRONIC WATCH

BACKGROUND OF THE INVENTION

1. Field of the Invention

The present invention relates to an electronic watch, and more particularly to a multifunctional electronic watch with a sensor and so on provided therein.

2. Related Art

A conventional multifunctional electronic watch with a sensor, as described in Japanese Utility Model Laid-Open No. SHO 61-154585 or Japanese Patent Laid-Open No. HEI 4-64085, has a raised portion on the outer periphery of a cover case of the watch in which a sensor mechanism is accommodated so that a time display and the sensor may not overlap with each other.

In Japanese Utility Model Laid-Open No. HEI 4-43238, a multifunctional electronic watch is disclosed which has an additional function of a barometer or an altimeter by providing a pressure sensor in the electronic watch. This watch is designed to display the weather.

Further, in Japanese Patent Laid-Open No. SHO 60-260883, an electronic watch which adopts an adjustable drive system using a variety of detection pulse is disclosed in order to extend a battery life of the electronic watch.

Conventional electronic watches, however, have several disadvantages shown below which will impair the value of the added fictional when new functions are added.

First, because conventional electronic watches do not have a pointer, it is not easy to see the display. Further, since the cover case of the watch has a raised portion with a built-in sensor, the watch does not fit with a user's wrist or looks poor.

Second, in the case of a multifunctional electronic watch which can measure the atmospheric pressure value, in order to obtain a relative height or an atmospheric pressure which is corrected to sea level from the measurements, a number of operational buttons need to be placed because an operation for correction is needed, and the operation of the buttons is extremely complicated.

Third, in an analog display electronic watch with a sensor or an analog-digital display electronic watch, it is generally impossible to perform generation of drive-motor driving pulses and measurements by a sensor at the same timing because of the limitations of electric source feed capacity, the timing to drive each of them are staggered. Accordingly, when time is shown by a second, there is a limitation that the total of an output period of a motor drive pulse to drive a motor for displaying the present time and a period in which A/D converter is performed must not exceed 1 second. The double-integral type A/D converter circuit employed in a multifunctional electronic watch with a sensor need to have long enough time for integration in order to improve measurement accuracy. In addition, in the adjustable drive system, it takes a long time to combine a variety of pulses. Consequently, in order to secure enough integral time of A/D converter in a conventional analog electronic watch with a sensor, the adjustable drive system should be avoided or a simplified adjustable drive system should be employed.

Fourth, conventional electronic watches have often employed a step motor which can be driven to rotate in two directions in order to perform complicated displays quickly, in which case an error in the indicated position occurs when a rotational direction is changed owing to a backlash of a gear which transmits the motion of a step motor to a display pointer.

Fifth, in conventional analog display electronic watches, if a plurality of pointers are placed at the same height from a dial plate, a special mechanism is needed to avoid a mutual interference in order to correct the reference position of the pointer.

Sixth, in an electronic watch which has an additional function of displaying a battery life, a special counter must be established in order to detect a battery life.

Taking the before-mentioned problems, the main object of the present invention lies in providing an electronic watch which can minimize structural disadvantages in adding new functions.

The other object of the present invention is to provide an electronic watch with a sensor which can read the height from an atmospheric pressure and can reduce the atmospheric pressure to sea level, as a new function, without requiring a complicated structure or operation.

Another object of the present invention is to provide an electronic watch with a simple structure which can display the variation of such environmental data as an atmospheric pressure value. Furthermore, the present invention intends to provide an electronic watch which does not ruin thinning, fitting, reliability of display or lowered power consumption when the above fictional are added.

SUMMARY OF THE INVENTION

In order to achieve the above and other objects, in a first form of the present invention, an electronic watch is provided which has an atmospheric pressure measurement means for measuring the atmospheric pressure, an atmospheric pressure display means for displaying the measurements of the atmospheric pressure measurement means with an indication point of an atmospheric pressure pointer to an atmospheric pressure scale, and a time display means for displaying the time. In other words, the present invention is characterized by indicating the measured atmospheric pressure value with the atmospheric pressure pointer. In this case, it is preferred to provide a rotational bezel with a height scale concentric circular with the atmospheric pressure scale around the atmospheric pressure scale.

The watch according to the present invention has the rotational bezel which has the height scale concentric to the atmospheric pressure scale. Hence, it is possible to read an atmospheric pressure value from the position of an atmospheric pressure pointer, and to read a height easily from the height scale on the rotation bezel set at a fixed angle position. It is also possible to easily carry out an operation of reduction to sea level in which the measured atmospheric pressure value is calibrated to an atmospheric pressure value at a height of 0 m by a simple operation of the rotation bezel. The distribution of atmospheric pressure on a weather map on TV or in a newspaper is in the form reduced to the sea level, and the atmospheric pressure value found there is different from the actual atmospheric pressure value. But if the electronic watch according to the present invention is employed, when the present atmospheric pressure value and the height are known, it is possible to know the atmospheric pressure value on a weather map by setting the position of the atmospheric pressure pointer at that of the rotation bezel, and by reading an atmospheric pressure value corresponding to 0 of the height scale. Consequently, there is no need for an intricate constitution to operate a measured atmospheric pressure value or for a complicated button operation.

In a second form of the present invention, an electronic watch has a sensor to measure such environmental data as atmospheric pressure value, humidity and temperature, an environmental data display means to show the measurements of the sensor with an environmental data display pointer, and a time display means to indicate time, in which the environmental data display means has a variation detection means to detect the change of measurements at a given interval based on the measurements of the sensor, and a variation display pointer to indicate the variation of the environmental data based on the detection of the detection means.

Accordingly, if the pointer to indicate a variation amount is formed to indicate a variation amount of environmental data such as an atmospheric pressure value, change in the environment can be easily seen from the pointer, and it is easy to know whether the weather is improving or breaking, for example. Further, since all the watch has to do is to indicate the tendency of change, the watch is constituted of the type having the pointers. Accordingly, there is no need to read a number and change can be judged comparatively.

In a third form of the present invention, an electronic watch has a sensor to measure environmental data, an environmental data display means to show the measurements of the sensor with an environmental data display pointer, a time display means to indicate time, a battery serving as a drive source of the sensor, the environmental data display means and the time display means, and an integrated circuit to control the environmental data display means and the time display means, in which the integrated circuit, the sensor and the battery are placed so that they are deviated with one another on a plane.

In a fourth form of the preset invention, an electronic watch has a sensor to measure environmental data, an environmental data display means to show the measurements of the sensor with an environmental data display pointer, and a time display means to indicate time, in which the sensor is placed inside an approximately circular movement.

In a fifth form of the present invention, an electronic watch has a sensor to measure environmental data, a pointer to indicate either the measurements of the sensor or time, and a drive motor to rotate the pointer through a wheel train, in which the sensor, the wheel train and the drive motor are placed so that they are deviated with one another on a plane.

According to the present invention, the IC, the sensor and the battery are positioned in such a way as not to overlap on a plane, which is advantageous in thinning an electronic watch. Similarly, if the sensor, the wheel train and the drive motor are positioned in such a way as not to overlap on a plane, it becomes easier to thin an electronic watch. In addition, if the sensor is placed inside the movement, the watch case has no raised portion on its outer surface, so that a fitting of the electronic watch can be improved.

In a sixth form of the present invention, there is provided an electronic watch having a sensor to measure environmental data, an environmental data display means to show the measurements of the sensor with an environmental data display pointer, a time display means to indicate time, a base frame on which said components are mounted, and a cover case housing said base frame and said components therein. The base frame is provided with a sensor containment portion in which the sensor is accommodated, a first packing to secure waterproofness between the inside of the sensor containment portion and the sensor, and a first through hole formed in a raised portion from the base frame and leading from the tip of the raised portion to the sensor containment portion. The cover case is provided with a concave into which the raised portion is fixed, a second packing to secure waterproofness between the concave and the raised portion, and a second through hole which connects the surface of the sensor with the outside of the cover case by leading to the first through hole with the raised portion fixed into the concave.

In this arrangement, it is preferred that the first through hole be formed nearer to the outer periphery of the sensor containment portion. It is also preferable that the first through hole be formed on the outer periphery side offset from a date wheel included in the time display means on a plane. It is further preferred that an outer opening of the second through hole be covered either with the rotational bezel attached on the outer surface of the cover case or with a fixing frame through a gap.

According to this arrangement, since the sensor and the outside of the cover case are connected by the first through hole on the base side and the second through hole on the cover case side, the sensor and the outside can be connected without establishing a raised portion in the cover case. If the first through hole is formed nearer to the outer periphery of the sensor containment portion or on the outer periphery side of the date wheel, the hole can connect the sensor and the outside without being prevented by other components. Particularly, if the outside opening of the second through hole is covered with the rotation bezel or a fixing frame, it is possible to prevent foreign particles or dust from going into the sensing face, hence improvement of reliability.

In a seventh form of the present invention, an electronic watch has a sensor to measure environmental data intermittently, an environmental data display means to show the measurements of the sensor, a time indication means to indicate time with a time indication pointer, in which the time indication means has a means to changeover the handling of a pointer to changeover the handling of the time indication pointer between the measurement period of environmental data of the sensor and the cessation period of the measurement of the environmental data.

The time indication means according to the present invention has a pointer movement changeover means which changes the way of moving a time indication pointer during the measurement period of environmental data of a sensor and a pause period of the environmental data measurement. Consequently, according to the present invention, in an analog electronic watch with a sensor or an analog-digital electronic watch, it is possible to move a pointer in a short time in the measurement period of environmental data of the sensor, and to move a pointer so as to contribute to save electricity in the other period. Therefore, enough time to carry out an A/D converter can be secured if the correction drive system is adopted.

In an eighth form of the present invention, an electronic watch has a sensor to measure environmental data, an environmental data indication means to indicate the measurements of the sensor by rotating an environmental data indication pointer clockwise and counterclockwise to a fixed position with a step motor, and a time indication means to indicate time, in which the environmental data indication means has a backlash prevention means which drives to travel the environmental data indication pointer in a larger number of steps than the number of steps to a fixed position when the rotational direction of the environmental data indication pointer is changed.

According to the present invention, because a watch has a backlash prevention means which puts forward an environmental data indication pointer much when the rotation direction of the environmental data indication pointer is changed, if a drive method in which the rotation direction of a pointer is reversed is adopted, there occurs no slip of a pointer caused by backlash.

In a ninth form of the present invention, an electronic watch has a sensor to measure environmental data, an environmental data indication means to indicate the measurements of the sensor with an environmental data indication pointer, and a time indication means to indicate time with a time indication pointer, in which a wheel train for the environmental data indication pointer has a gear with a tooth portion formed only on a part of the outer periphery, and in which the outer periphery area of the gear where the tooth portion is not formed defines the rotational angle range of the environmental data indication pointer.

In this arrangement, it is preferred to provide a pointer position adjustment means to rotate the environmental data indication pointer in a first direction until it is prevented to rotate by the area where the tooth portion is not formed. In this case, it is preferable that the pointer position adjustment means, after rotating the environmental data indication pointer in the first direction until it stops by the area where the tooth portion is not formed, rotate the environmental data indication pointer in a second direction opposite to the first direction to a fixed angle position from the stop position. The first direction is preferably opposite to a normal drive direction of a step motor to rotate the environmental data indication pointer.

According to the present invention, a rotation angle range of the second pointer can be easily determined by the gear which has tooth portion formed only in a part of the outer periphery in a wheel train of the second pointer. In addition, if the stop position of the pointer is determined surely by an area of the gear where there are no tooth formed, the position of the pointer can be easily adjusted with the stop position as a reference position.

In a tenth form of the present invention, an electronic watch has a sensor to measure environmental data, an environmental data indication means to indicate the measurements of the sensor, and a time indication means to indicate time, in which the environmental data indication means has a specific-data storage means to store specific data including either the maximum value or the minimum value of the environmental data, a specific-data indication means to indicate the specific data stored in the storage means, and a specific-data renewal means which makes the sensor measure environmental data immediately before the specific-data indication means indicates the specific data stored in the specific-data storage means and which renews the specific date to be indicated based on the measurements.

Since the environmental data indication means according to the present invention has the specific data renewal means which makes the sensor measure environmental data immediately before the indication of specific data, information can be indicated based on the latest information. Further, if abnormal data are detected during the operation, the abnormal data are not indicated.

In an eleventh form of the present invention, an electronic watch has a sensor to measure environmental data, an environmental data indication means to indicate the measurements of the sensor, a time indication means to indicate time, and a calibration means to calibrate the difference between the measurements of the sensor and the indication, in which the calibration means makes the sensor measure environmental data during the operation to get in a mode which can be calibrated and makes the environmental indication means indicate the measurements. In this case, it is preferred that the calibration means have an alarm means to make an alarm which indicates the start of the calibration immediately after the calibration begins.

According to the present invention, in order to calibrate a differential between the measurements of the sensor and the indication, environmental data of the sensor is measured during the calibration operation, so it is possible to carry out correct calibration. In addition, since an alarm is produced immediately after the calibration operation is started, voltage does not lower during the calibration and therefore the calibration can be carried out in a stable condition.

In a twelfth form of the present invention, an electronic watch has a sensor to measure environmental data, an environmental data indication means to indicate the measurements of the sensor, a time indication means to indicate time, in which the environmental data indication means has an abnormal data detection means to detect the presence of abnormal data out of the measurements of the sensor, and a data correction means to calculate an indication content based on the data obtained by excluding abnormal data from the measurements of the sensor making use of the detection result of the abnormal data detection means.

For example, the abnormal data detection means, of a group of data indicating a variation amount of environmental data every certain time measured by the sensor in a fixed unit time, regards data with a value bigger than a fixed value as abnormal, and the data correction means calculates to generate as an indication content the content obtained by supplementing a variation amount of environmental data before and after the unit period passes based on the data obtained by excluding abnormal data from the group of data. Or, the abnormal data detection means can regard a data with a differential bigger than a fixed set value compared with any other data as abnormal, of a group of data measured by the sensor every certain time in each period into which a fixed unit period is equally divided, and the data correction means can calculate an average value from the data from which abnormal data are excluded in each equally divided period, and then can calculate as an indication content a variation amount of environmental data before and after the unit period passes based on these average values. Alternatively, the abnormal data detection means can regard a data with a differential bigger than a fixed set value compared with any other data as abnormal, of a group of data measured by the sensor every certain time in each period into which a fixed unit period is equally divided, and the data correction means can calculate an average value from the data from which abnormal data are excluded in each equally divided period and then, of these average values, based on an average value of which a differential from an average value in a period immediately before is smaller than a fixed value, can operate as an indication content the content obtained by supplementing a variation amount of environmental data before and after the unit period passes.

In such a case, if there are more than a fixed number of abnormal data, the data correction means can calculate a variation amount of environmental data based on all the data measured in the unit period. Alternatively, if there are more than a fixed number of abnormal data, the data correction means can regard a variation amount of environmental data in the unit period as zero.

Accordingly, since the watch according to the present invention has an abnormal data detection means to detect the presence of abnormal data from the measurements of the sensor and the indication content is operated after abnormal data are excluded, it is possible to indicate correct information.

In a thirteenth form of the present invention, an electronic watch has a plurality of pointers and a drive motor to drive and rotate these pointers through a wheel train, in which the plurality of pointers include a first pointer which can rotate in a rage of 360 degrees, and a second pointer which is driven by the same drive motor as the first pointer and which rotates around the center of a clockface as the rotational center with an indication unit and a rotational angle range different from those of the first pointer.

In this arrangement, it is preferred that there be a supplementary pointer which rotates at the same height position as the second pointer from the clockface in an area not overlapping the rotational area of the second pointer. It is also preferred that a wheel train to the second pointer have a gear having a tooth portion formed only in a part of the outer periphery, and that the remaining area of the gear outer periphery where the tooth portion is not formed determines the rotational angle range of the second pointer.

In a fourteenth form of the present invention, an electronic watch has a time indication means to indicate time, an additional-function drive means to perform a fixed additional operation intermittently, and a power source portion to drive the additional-function drive means and the time indication means, in which the power source portion has a power source voltage detection means which detects power source voltage synchronous with the timing of the operation performed intermittently by the additional-function drive means. In this case, it is preferred to install a drive control means to stop the operation of the additional-function drive means after power source voltage lowers based on the detection result of the power source voltage detection means. In this case, it is possible to adopt as the additional-function drive means an alarm means which compares intermittently the present time and an alarm set time, and which produces an alarm when the alarm means judges that the present time and the alarm set time coincide.

According to the present invention, the power source portion has the power source voltage detection means to detect power source voltage every time an additional function drive means operates. Therefore, power source voltage can be observed regularly without forming a special counter means by detecting power source voltage to the timing in which the additional fulnction drive means operates.

Any form of the electronic watch according to the present invention can measure and indicate such environmental data as humidity and temperature, and particularly, when the watch measures and indicates such pressure values as atmospheric pressure and water pressure, it offers convenience to those who enjoy themselves outdoors.

The above and other objects and advantages of the present invention will be apparent from reading the following description with reference to the attached drawings.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference characters denote similar elements throughout the several views:

FIG. 14 is a memory map of the CPU-IC of the multifunctional electronic watch of Example 1;

FIG. 17 is a memory map of the CPU-IC of the multifunctional electronic watch according to a second embodiment of the present invention;

FIG. 19 is a flow chart illustrating an atmospheric pressure indication operation of the multifunctional electronic watch of the second embodiment;

DESCRIPTION OF THE PREFERRED EMBODIMENTS

Figure 1:
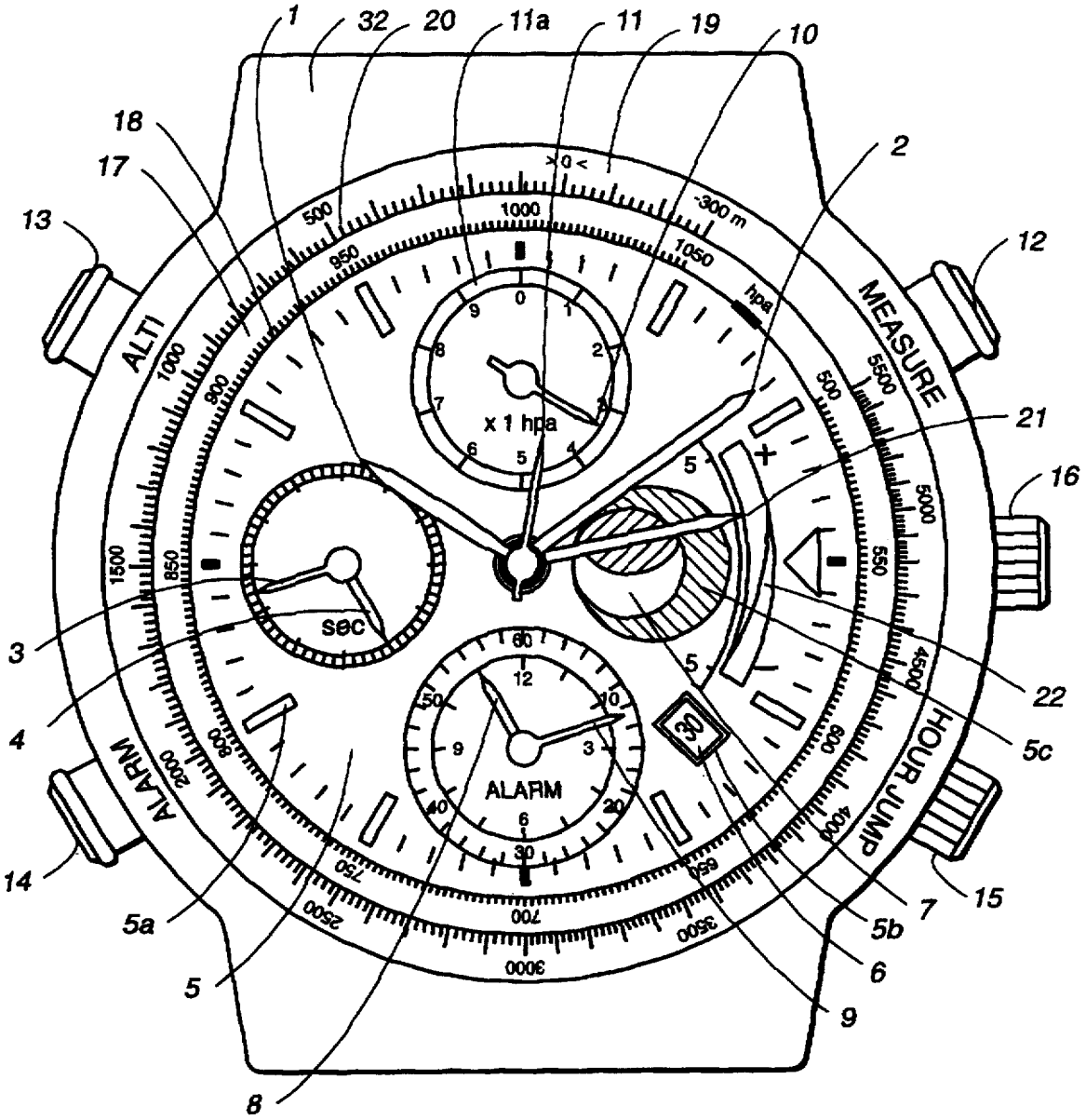
FIG. 1 is a plan view illustrating the appearance of the principal portion of a multifunctional electronic watch having a sensor in accordance with the present invention.

FIG. 1 is a plan view illustrating the appearance of the principal part of a multifunctional electronic watch to the present invention in accordance with a first embodiment. Referring to FIG. 1, a multifunctional electronic watch having a sensor W has an hour hand 1 and a minute hand 2 as center pointers, and a second hand 3 and an hour hand 4 as supplementary hands attached in a direction pointing to 9 o'clock. A clockface 5 has a 12-hour system scale 5*a* in a position corresponding to the hour hand 1, and a window 5*b* through which to view a date dial 6 indicating a calendar date. Window 5*b* is located, for example, between a direction pointing to 5 o'clock and a direction pointing to 4 o'clock.

In a direction pointing to 3 o'clock of the clockface 5 are a window 5*c* through which to view a dial or wheel 7 to indicate the phase of the moon. In other words, through window 5*c* the waxing and waning of the moon is indicated by dial 7. In the preferred embodiment, dial 7 is interlocked to the hour hand 1.

Referring again to FIG. 1, in the direction pointing to 6 o'clock of clockface 5 are an alarm hour hand 8 and an alarm minute hand 9 to indicate alarm time. When the current time coincides with the alarm time, an alarm is produced for 20 seconds. The alarm time is set by operating a 4-o'clock crown 15 placed in a direction pointing to 4 o'clock.

The operation for setting an alarm is explained as follows. To set the alarm time, an 8-o'clock button 14 in an 8-o'clock direction is pressed, and an alarm minute hand 9 and an alarm hour hand 8 are incremented in minutes. In this manner, the alarm time can be set at a desired time up to a 12-hour range. If 8-o'clock button 14 remains pressed, the alarm minute hand 9 and the alarm hour hand 8 rotate continuously with acceleration, so the alarm time can be set in a short time. For instance, when 4-o'clock crown 15 is pushed to a normal position, the watch is in a so-called "one-touch alarm mode", wherein after an alarm is produced once, the alarm set is removed.

When 4-o'clock crown 15 is pulled out by one step, the watch is placed in a so-called "daily alarm mode". In this mode an alarm is produced twice every 12 hours at the set time every day. Additionally, the alarm time can be set similarly by depressing 8-o'clock button 14 to increment alarm minute hand 9 and alarm hour hand 8 rotate in minutes. If 8-o'clock button 14 remains to be pressed, the alarm minute hand 9 and the alarm hour hand 8 rotate continuously with an acceleration, so the alarm time can be set in a short time.

In the preferred embodiment, 4-o'clock crown 15 is pulled out by two steps, the watch is set in a time-differential correction mode. In this mode, when 8-o'clock button 14 is depressed, alarm minute hand 9 and alarm hour hand 8 are moved forward in increments of hours, so a time differential of the alarm set time can be corrected. If 4-o'clock crown 15 is rotated in this mode, the hour hand 1 can be rotated separately. A time differential can be corrected in this way, too.

Alarm hour hand 8 and alarm minute hand 9 indicate time in minutes after producing an alarm in the one-touch alarm mode. The operation in this case is independent of hour hand 1 and minute hand 2. Accordingly, a time differential of alarm hour hand 8 and alarm minute hand 9 is sometimes corrected. In this case, when a small second hand 3 is positioned to a 0-second position, after a 3-o'clock stem 16 is pulled out by two steps, the watch is set by depressing 8-o'clock button 14, and then 3-o'clock crown 16 is depressed to the normal condition. A time differential can also be corrected by rotating 3-o'clock crown 16 with 3-o'clock crown 16 pulled out by two steps. The watch is made to be easier for users to handle by causing the watch to produce an alarm every time 3-o'clock crown 16 is pulled out.

A calendar and the phase of the moon can be adjusted by rotating 3-o'clock crown 16 with 3-o'clock crown 16 pulled out by one step. The 3-o'clock crown 16 also functions as a changeover switch of an atmospheric pressure indication function described hereinbelow when the 3-o'clock crown 16 is in normal position.

The multifunctional electronic watch of the preferred embodiment including a sensor in this example has an atmospheric pressure pointer 11 arranged in the center of clockface 5 which indicates 2 hPa per step, and an atmospheric pressure scale 18 in a dial ring 17 disposed around the clockface 5. In a direction pointing to 12 o'clock of clockface 5 the watch comprises a small atmospheric pressure pointer 10 to indicate a unit of lower order of magnitude of an atmospheric pressure, around which a small atmospheric pressure scale 11*a* is printed. When the watch is carried in a normal condition, if 3-o'clock crown 16 is pushed to a normal condition, an atmospheric pressure value is measured every ten minutes by an atmospheric pressure sensor described later. The measured data converted from an analog value to a digital value for indication by small atmospheric pressure pointer 10 and atmospheric pressure pointer 11. The watch is placed in a continuous measurement mode of an atmospheric pressure by depressing a 2-o'clock button 12, located in a direction pointing to 2 o'clock while the 3-o'clock crown 16 pushed to a normal condition. In this mode of operation, atmospheric pressure is measured continuously for five minutes every five seconds. When a 10 o'clock button 13, placed in a direction pointing to 10 o'clock is depressed, the watch is in a lowest atmospheric pressure call mode, and the lowest atmospheric pressure value that has been measured so far is displayed by small atmospheric pressure pointer 10 and atmospheric pressure pointer 11. Of course, it is possible to display the highest atmospheric pressure value instead of the lowest atmospheric pressure value. However, it is desirable to indicate the lowest value in order to monitor changes in the weather.

Referring again to FIG. 1, on the outer periphery of dial ring 17 is a rotational bezel 19 which is arranged concentric to the atmospheric pressure scale 18. Rotational bezel 19 can be rotated in a circumferential direction. On the surface of the rotational bezel 19 is an elevation or height scale 20. Accordingly, it is possible to read an atmospheric pressure value from the position of atmospheric pressure pointer 11 and atmospheric pressure scale 18 of the dial ring 17, and to thus read a relative height or elevation from elevation scale 20. That is, if the elevation is 10 m higher, atmospheric pressure generally changes in a range of 12 hPa to 8 hPa. For example, provided that the present location is at a height of 0 m and an atmospheric pressure value is 1013 hPa, the rotational bezel 19 is rotated so that a height 0 m of a height scale 20 is set at 1013 hPa. After relocation to a different location having a different height, if atmospheric pressure pointer 11 points to 900 hPa, height scale 20 displays a height of about 1000 m. While, atmospheric pressure generally changes as little as 2 hPa to 3 hPa a day, if the relocation is accomplished in a relatively short time, it is possible to determine the relative height from the known height.

The multifunctional electronic watch with a sensor W in this example is capable of carrying out an operation of reduction to sea level by correcting the atmospheric pressure value actually measured to the value measured at a height of 0 m so long as the present atmospheric pressure value and the height of the place are known. Generally, on a weather map broadcast on TV or published in a newspaper, the distribution of atmospheric pressure is shown with atmospheric pressure values being adjusted to sea level for convenience sake. Therefore, in comparing the atmospheric pressure value actually measured with the published atmospheric pressure value, the atmospheric pressure value actually measured needs to be adjusted to sea level. In such a case, the multifunctional electronic watch in the preferred embodiment the measured value can be adjusted to sea level by simply operating the rotational bezel 19. When an atmospheric pressure value is 900 hPa at a height of 1000 m, for instance, a height 1000 m of height scale is set at 900 hPa of the atmospheric pressure scale 18 by rotating the rotational bezel 19, and the atmospheric pressure in a position of a height 0 mis read. If the value is 1012 hPa, the adjusted atmospheric pressure is 1012 hPa.

Furthermore, in this example, the watch includes an atmospheric pressure tendency pointer 21 as a center pointer which displays the differential between the present atmospheric pressure and the atmospheric pressure about three hours before. The atmospheric pressure tendency pointer 21 has a 3-o'clock direction as plus or minus 0. If the pointer 21 is off-set to the upper right, atmospheric pressure is in an increasing trend, while if the pointer 21 is off-set to the lower right, atmospheric pressure is in a decreasing trend. Consequently, it is possible to determine whether the weather is improving or not by reading the change in atmospheric pressure from the atmospheric pressure tendency pointer 21. As is generally known, when atmospheric pressure is increasing, the weather is improving, and when atmospheric pressure is lowering, the weather is deteriorating.

Drive Mechanism

Figure 2:
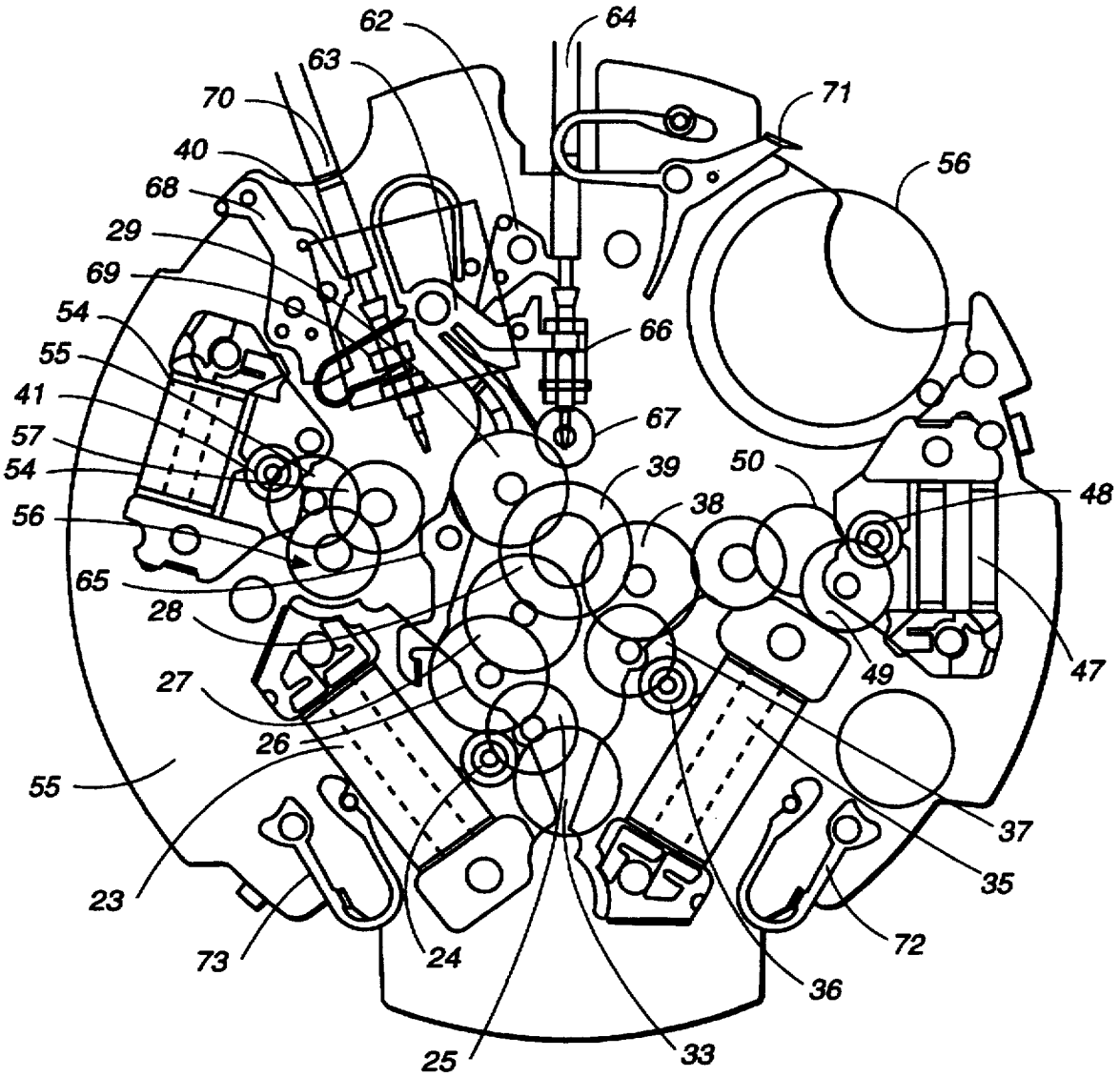
FIG. 2 is a rear view of the interior of the multifunctional electronic watch the sensor of FIG. 1.

A drive mechanism of the preferred multifunctional electronic watch will be described with reference to FIGS. 2 to 8. FIG. 2 is a plan view illustrating a constitution of a wheel train, a motor, a changeover system and a switching system of the multifunctional electronic watch with. a sensor in this example.

In FIG. 2, the watch, in this example, has four built-in stepping motors 23, 35, 54 and 47, each of which is composed of a coil block, a stator and a rotor. The coil block is composed of a magnetic core made of a material of high permeability, a coil wound around the magnetic core, a coil lead base having electrically conductive portions on its both ends, and a coil frame. The stator, like the magnetic core, is composed of a material of high permeability. The rotor has a metal pinion attached to a rotor magnet.

Each of the stepping motors 23, 35, 54 and 47 is rotated by a drive pulse output from a controller such as CPU-IC 40. In the preferred embodiment, a power supply, such as by way of example a coin-type lithium battery applies a 3 VDC to the coil.

Figure 3:
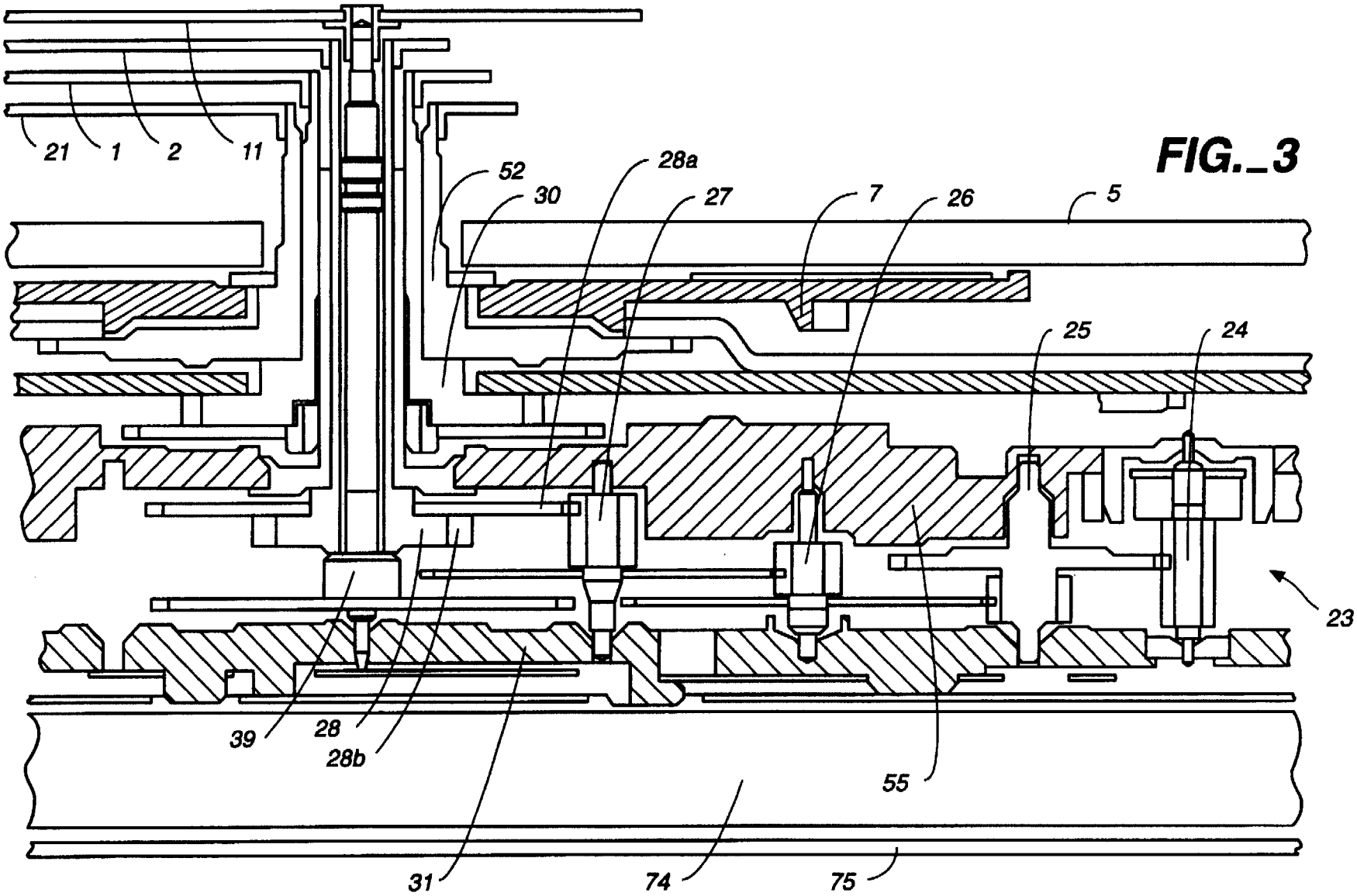
FIG. 3 is a partial cross-sectional view illustrating a drive mechanism indicating normal time in the multifunctional electronic watch of FIG. 1.
Figure 4:
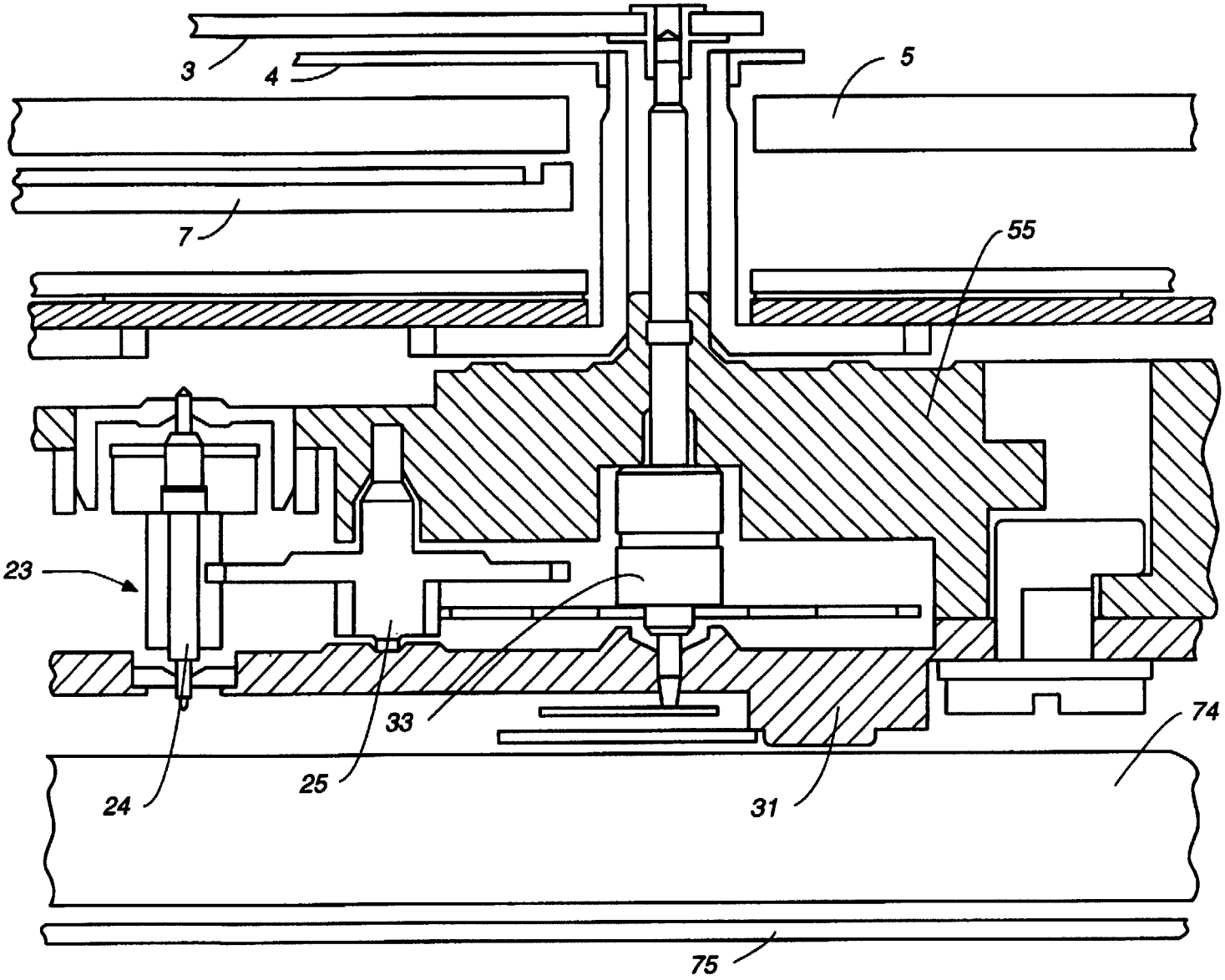
FIG. 4 is a partial cross-sectional view taken along the direction of the 8-o'clock illustrating a drive mechanism indicating normal time in the multifunctional electronic watch of FIG. 1.

Of these stepping motors, stepping motor 23 in A series is a drive source for displaying the actual time. As shown in FIG. 3, stepping motor 23 rotates and drives the wheel trains consisting of a rotor 24, a fifth wheel 25, a fourth wheel 26, a third wheel 27 and a second wheel 28. Of these wheels, second wheel 28 is located in the central portion of the watch body. A day rear-side wheel 29 and a cartridge wheel 30 located in the center of the watch body are connected with this wheel train mechanically. A small second hand 33 is, as shown in FIG. 4, mechanically connected with the fifth wheel 25 displaying the seconds of the actual time. A time indication means in this example is thus constituted to display the time by the rotation of a time indication pointers.

Figure 5:
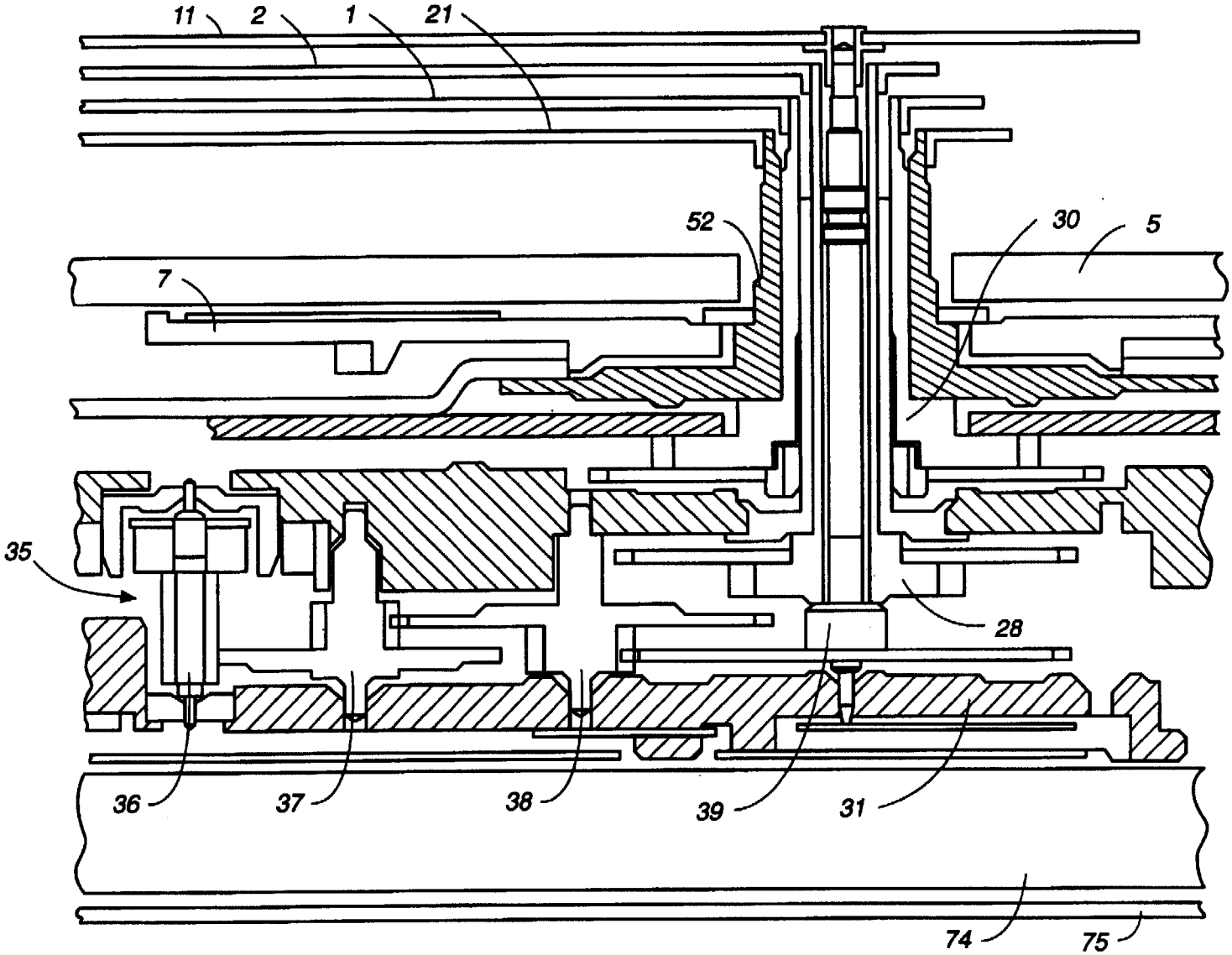
FIG. 5 is a partial cross-sectional view taken along the direction of the 9-o'clock illustrating a drive mechanism indicating normal time in the multifunctional electronic watch of FIG. 1.

In FIGS. 2 and 5, the stepping motor 35 in B series is a drive source for displaying the atmospheric pressure and height. As shown in FIG. 5, stepping motor 35 rotates and drives a wheel train consisting of a rotor 36, a first atmospheric pressure indication middle wheel 37, a second atmospheric pressure indication middle wheel 38 and an atmospheric pressure indication wheel 39 in either the clockwise or counterclockwise direction. Of these wheels, the atmospheric pressure indication wheel 39 is in the central portion of the watch body and is mechanically connected to atmospheric pressure pointer 11. Atmospheric pressure pointer 11, arranged in the central portion of the watch body, indicates atmospheric pressure from 500 hPa to 1050 hPa in 2 hPa increments, and at the same time can indicate a height from 300 m below sea level to 5500 m above sea level. This is accomplished by converting the atmospheric pressures into a standard height as explained hereinabove. Note that stepping motor 35 and step motor 23 employ the same type of coil blocks having an electrical resistance of about 3 k ohm which generate magnetic motive force of about 10 A.

Figure 6:
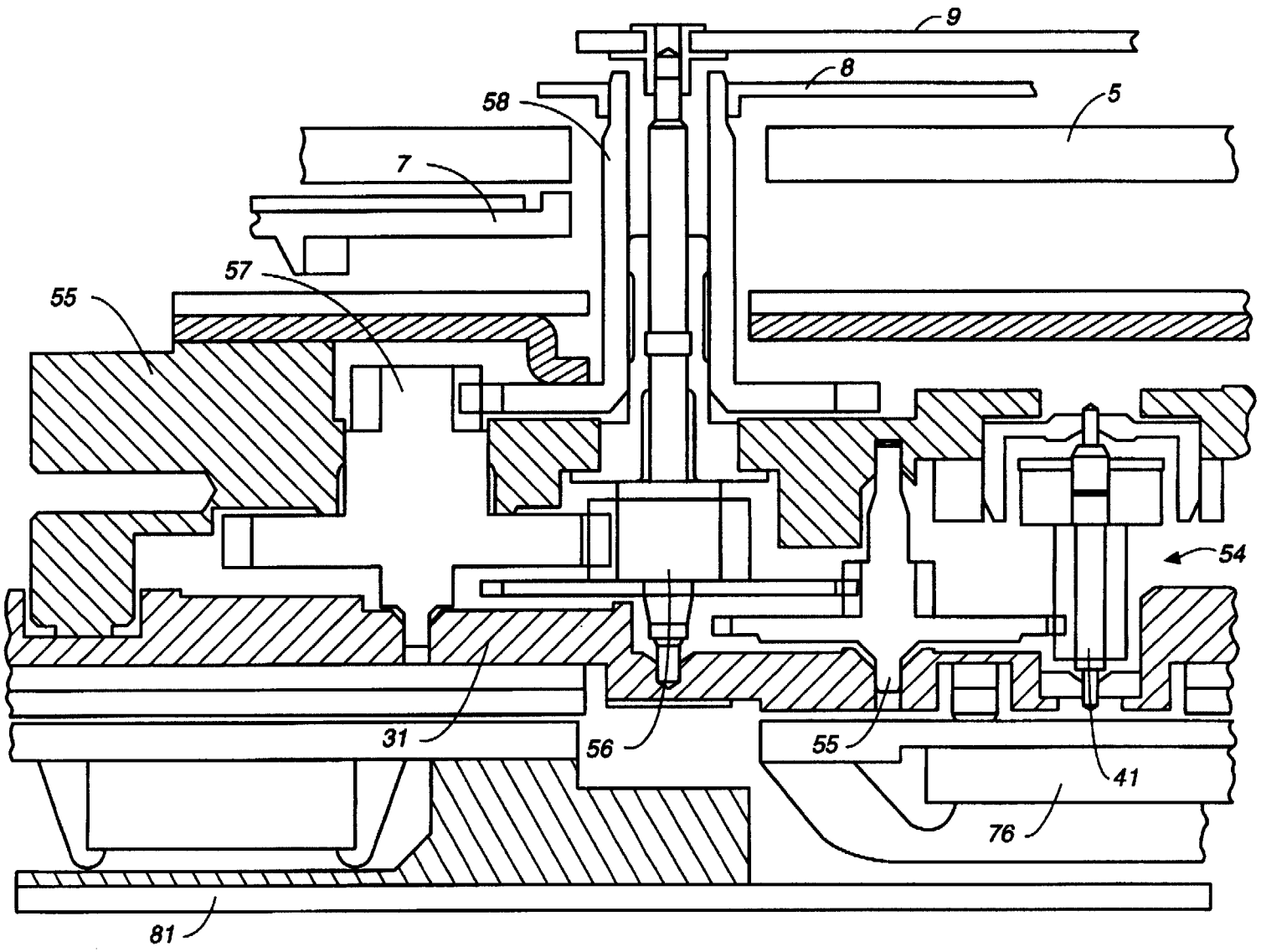
FIG. 6 is a partial cross-sectional view taken along the direction of the 10-o'clock illustrating a drive mechanism indicating an atmospheric pressure value in the multifunctional electronic watch of FIG. 1.

In FIGS. 2 and 6, stepping motor 54 in C series is a drive source for displaying an alarm set time. Stepping motor 54 rotates and drives a wheel train consisting of a rotor 41, an alarm middle wheel 55, an alarm minute wheel 56, a day rear-side wheel 57 for alarming and an alarm cartridge wheel 58. Of these wheels, the alarm minute wheel 56 and the alarm cartridge wheel 58 position alarm hour hand 8 and alarm minute hand 9, respectively, in a forward or clockwise direction pointing to 6 o'clock. The stepping motor 54 moves the hands forward in increments of minutes when an alarm time is set normally, but if 8-o'clock button 14 is depressed, stepping motor 51 moves the hands rapidly in a clockwise direction by 64 increments of seconds. Stepping motor 54 occupies a smaller area than the other stepping motors 23 and 35. In addition, since the coil of stepping motor 54 uses fine lead wires, its electrical resistance value is about 2.6 k ohm and is capable of generating a magnetomotive force of about 8 A.

Figure 7:
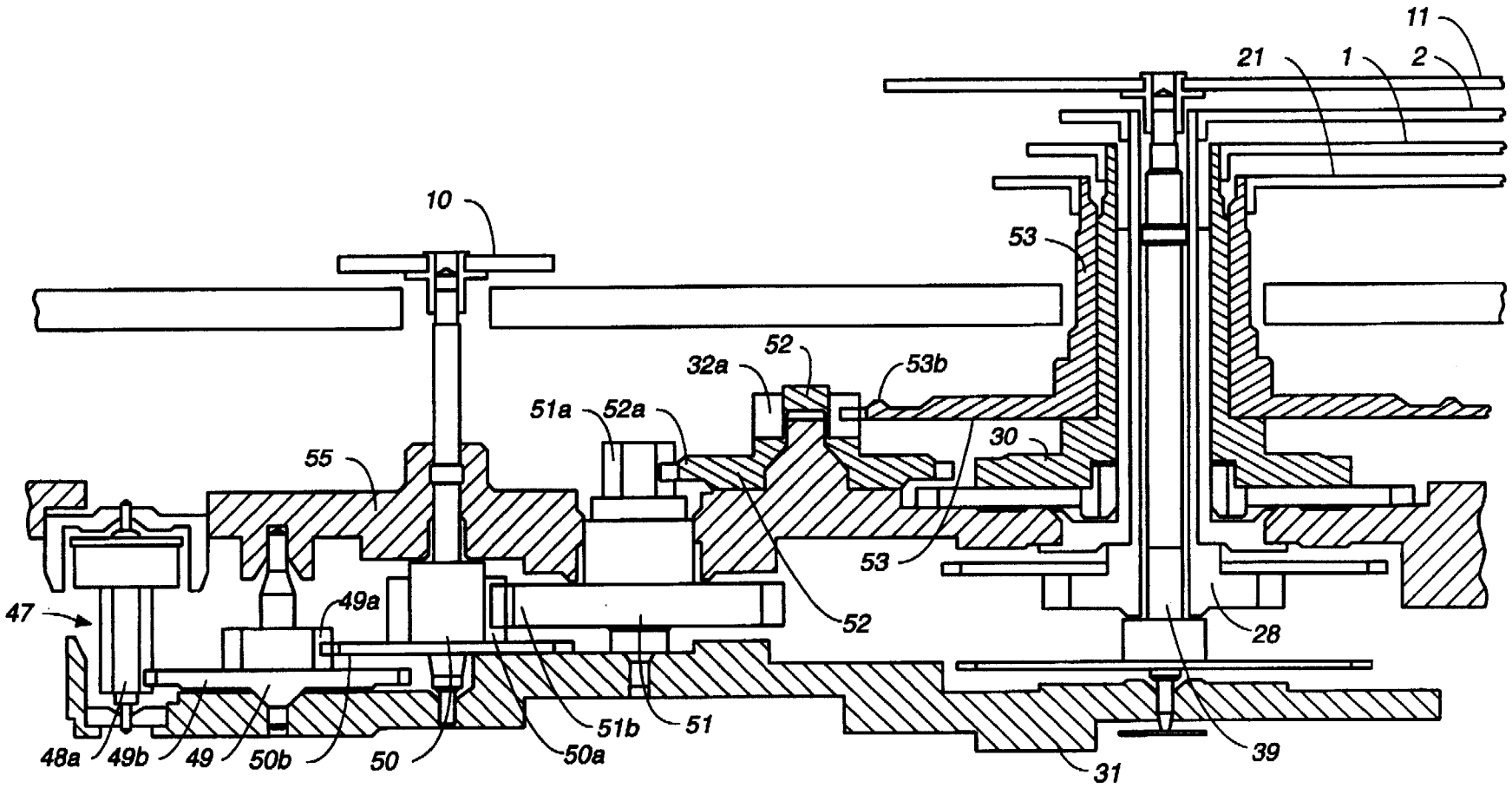
FIG. 7 is a partial cross-sectional view taken along the direction of the 12-o'clock illustrating a drive mechanism indicating alarm time in the multifunctional electronic watch sensor of FIG. 1.

In FIGS. 3 and 7, the stepping motor 47 in D series is a drive source displaying an atmospheric pressure value lower than 10 hPa in 1 hPa increments and displaying a relative change of atmospheric pressure. Stepping motor 47 rotates and drives a wheel train consisting of a rotor 48, a middle wheel in 49 and an indication wheel in 50. Of these wheels, the indication wheel 50 has small atmospheric pressure pointer 10 attached to the end in a direction pointing to 12 o'clock.

A pinion **48*a* of rotor in 48 meshes with a gear 49*b* of middle wheel 49, a pinion 49*a* of middle wheel 49 meshes with a gear 50*b* of indication wheel 50. Preferably, the reduction ratio from the pinion 48*a* of rotor 48 to gear 50*b* of the indication wheel 50 is 1/15. Since the rotor 48 rotates 180 degrees per step, indication wheel 50 rotates 360 degrees or a complete revolution in 30 steps. Since CPU-IC 40 outputs drive pulses for 3 steps to the step motor 47 if atmospheric pressure changes by 1 hPa, small atmospheric pressure pointer 10 attached to indication wheel 50 indicates 10 hPa. Thus, in this example, an atmospheric pressure indication means for displaying an atmospheric pressure value includes small atmospheric pressure pointer 10 and atmospheric pressure pointer 11**. As will be appreciated by one of ordinary skills in the art, the watch can include other types of sensors for measuring and sensor other kinds of environmental factors.

CPU-IC 40 outputs drive pulses for causing stepping motor 47 to move 3 steps. The pulses have widths of approximately 15 ms to 30 ms. Thus, apparently the rotation of the small atmospheric pressure pointer 10 is like when pointer 10 rotates one scale at a time, and so users do not feel a sense of incompatibility. Further, since one scale is divided into three parts, even if there is an error in the attachment angle position of small atmospheric pressure pointer 10 or the print position of the clockface, the distance between the small atmospheric pressure pointer 10 and the scale position can be reduced.

Turning to FIG. 7, the indication wheel 50 transmits a rotational drive force to a wheel train consisting of a measure indication middle wheel 51, a measure indication transmission wheel 52 and a measure indication wheel 53. That is, a pinion 50*a* of the indication wheel 50 meshes with a gear 51*b* of measure indication middle wheel 51, and a pinion 51*a* of measure indication middle wheel 51 meshes with a gear 52*b* of measure indication transmission wheel 52. A pinion 52*a* of measure indication transmission wheel 52 meshes with a gear 53*b* of measure indication wheel 53, and an atmospheric pressure tendency pointer 21 to display relative changes of atmospheric pressure is attached to the tip of a rotation shaft of measure indication wheel 53.

In FIG. 2, in a 3-o'clock direction is a first roll core 64 to which 3-o'clock winding crown 16 is attached. A pushing nail 62 and a latch 63 are connected mechanically with the tip of first roll core 64. Pushing nail 62 and latch 63 are engaged with a control lever 65 in a conventional manner. If first roll core 64 is pulled out by two steps, control lever 65 controls the rotation of fourth wheel 26, which causes rotor 24 to stop and small second hand 3 to stop moving. Even in this condition, since a second gear 28*a* is connected with a second pinion 28*b* with a certain slide torque, a small iron wheel 67, day rear-side wheel 29, pinion 28*b* of the second wheel and cartridge wheel 30 are free to rotate. Accordingly, in this operation hour hand 1 and minute hand 2 can also rotate. Consequently, hour hand 1 and minute hand 2 can be set aright by pulling out first roll core 64 by two steps.

If first roll core 64 is rotated while being pulled out by one step, the rotation force is transmitted to day rear-side wheel 29 through a barrel wheel 66 and a pinion 67 for adjusting the calendar.

In a 4-o'clock direction is a second roll core 70 to which 4-o'clock winding crown is attached. An alarm pushing nail 68 is mechanically connected with second roll core 70. The 4-o'clock winding crown 15 is used in setting an alarm time and adjusting only hour hand 1. In other words, only hour hand 1 can be rotated by operating the 4-o'clock crown 15 with first roll core 64 pulled out by two steps to rotate second roll core 70, and rotate a time adjustment barrel 69.

Note that in 2-o'clock, 10-o'clock and 8-o'clock directions switch levers 71, 72 and 73 are attached respectively. These switch levers 71, 72 and 73 are mechanically connected with a 2-o'clock button 12, a 10-o'clock button 13 and an 8-o'clock button 14 respectively, which elevates the touch of the operation of these buttons.

Relationship of Small Atmospheric Pressure Pointer and Atmospheric Pressure Tendency Pointer The mechanical relation between small atmospheric pressure pointer 10 and atmospheric pressure tendency pointer 21 will be explained below.

In FIG. 1, an atmospheric pressure tendency indication portion 22 with atmospheric pressure tendency pointer 21 is constituted in a direction pointing to 3 o'clock having an angular range from a direction pointing to 2 o'clock to a direction pointing to 4 o'clock. In atmospheric pressure tendency indication portion 22, the 3-o'clock direction is plus or minus 0, from where five scales are on both the plus side and the minus side at an angular interval of 6 degrees. One scale indicates that a relative differential between the atmospheric pressure measured about 3 hours before and the atmospheric pressure measured this time is 1 hPa. For example, if the atmospheric pressure newly measured this time is 1015 hPa and the measurement value about 3 hours before is 1013 hPa, atmospheric pressure increased by 2 hPa in 3 hours, and atmospheric pressure tendency pointer 21 points to an obliquely upward direction. If the measurement value about 3 hours before is 1017 hPa, atmospheric pressure tendency pointer 21 points to an obliquely downward direction. Thereafter, atmospheric pressure tendency pointer 21 indicates a relative differential of atmospheric pressure renewing the relative differential every 30 minutes.

Atmospheric pressure tendency pointer 21 rotates interlocked to the small atmospheric pressure pointer 10. While small atmospheric pressure pointer 10 indicates a measured atmospheric pressure value, atmospheric pressure tendency pointer 21 indicates the change in atmospheric pressure. That is, atmospheric pressure tendency pointer 21 has the same drive source as the small atmospheric pressure pointer 10 which can rotate a circle of 360 degrees, and which rotates in a unit system and in an angular scope different from the small atmospheric pressure pointer 10. In spite of that, in this example, both small atmospheric pressure pointer 10 and atmospheric pressure tendency pointer 21 are constructed as described below so that they can be driven by one step motor 47.

First, atmospheric pressure can be measured each interval. Each interval can be preferably from 5 seconds to 10 minutes. Atmospheric pressure tendency pointer 21 indicates the result of a relative comparison of the atmospheric pressure value measured this time with the atmospheric pressure value measured three hours before and recalculates the result every 30 minutes. If the small atmospheric pressure pointer 10 rotates when atmospheric pressure changes at an interval between recalculation times, the atmospheric pressure tendency pointer 21 also rotates. As was described with reference to FIGS. 2 and 6, however, since the reduction ratio from the pinion 50*a* of the indication wheel to the measure indication wheel 53 is 1/120, rotation angle of the measure indication wheel 53 is extremely small. It is noted, atmospheric pressure generally changes at most 2 hPa to 3 hPa in an hour. Accordingly, if the rotation angle of small atmospheric pressure pointer 10 in 30 minutes is 72 degrees, the rotation angle of measure indication wheel 53 is only about 0.6 degrees.

Consequently, atmospheric pressure tendency pointer 21 only rotates within a range of a plus or minus ¼ scale even if atmospheric pressure changes between recalculation times of indication. Moreover, the function of atmospheric pressure tendency pointer 21 is only to indicate the trend or relative change of atmospheric pressure with its angle of inclination. Accordingly, the difference value need not be displayed with an absolute of accuracy. Therefore, there is no problem in use even if the atmospheric pressure tendency pointer 21 rotates with the small atmospheric pressure pointer 10 at an interval between recalculation times as the two pointers are driven by one step motor. This arrangement has numerous benefits, since the same drive motor drives two pointers. More specifically, it is possible to increase an amount of information which can be displayed without sharply increasing the number of parts and complexity at a reduce cost.

Two middle wheels are arranged between small atmospheric pressure pointer and atmospheric pressure tendency pointer 21 as shown and, therefore, they rotate in the opposite directions. If small atmospheric pressure pointer 10 rotates 360 in a direction, atmospheric pressure tendency pointer 21 rotates 3 degrees in the opposite direction. If a relative change of atmospheric pressure is plus 2 hPa, small atmospheric pressure pointer 10 points to the original scale position of atmospheric pressure indication after rotating 4 times in the opposite direction.

As to the attachment position of small atmospheric pressure pointer 10 and atmospheric pressure tendency pointer 21, when the small atmospheric pressure pointer 10 is in a 0 position or 12-o'clock direction, atmospheric pressure tendency pointer 21 is mounted obliquely downward by an angle of 1.5 degrees or ¼ scale to the 0 position or the direction pointing to 3 o'clock. Accordingly, if small atmospheric pressure pointer 10 rotates by 5 scales of atmospheric pressure tendency pointer 21 in the forward rotational or clockwise direction, atmospheric pressure tendency pointer 21 rotates on the scale in the backward rotational or counterclockwise direction. This is advantageous because it is more convenient in observing the break of the weather to secure a wider range in which to display the lowering of atmospheric pressure. Small atmospheric pressure pointer 10, after rotating in the forward rotational direction until it reaches a awe position, rotates in the backward or counterclockwise direction to point to 0 hPa when the pointer increases by 1hpa. At this time the atmospheric pressure tendency pointer 21 points obliquely downward by an angle of 1.5 degrees or ¼ scale to the 0 position or the direction pointing to 3 o'clock. Similarly, when atmospheric pressure lowers and small atmospheric pressure pointer 10 rotates in the opposite direction to make a revolution, the atmospheric pressure tendency pointer 21 rotates in a rotation direction to return to 0 hPa.

Setting Small Atmospheric Pressure Pointer And Atmospheric Pressure Tendency Pointer At a Zero Point The way of setting small atmospheric pressure pointer 10 and atmospheric pressure tendency pointer 21 at zero point done in an exchange of batteries will be described below.

Figure 8:
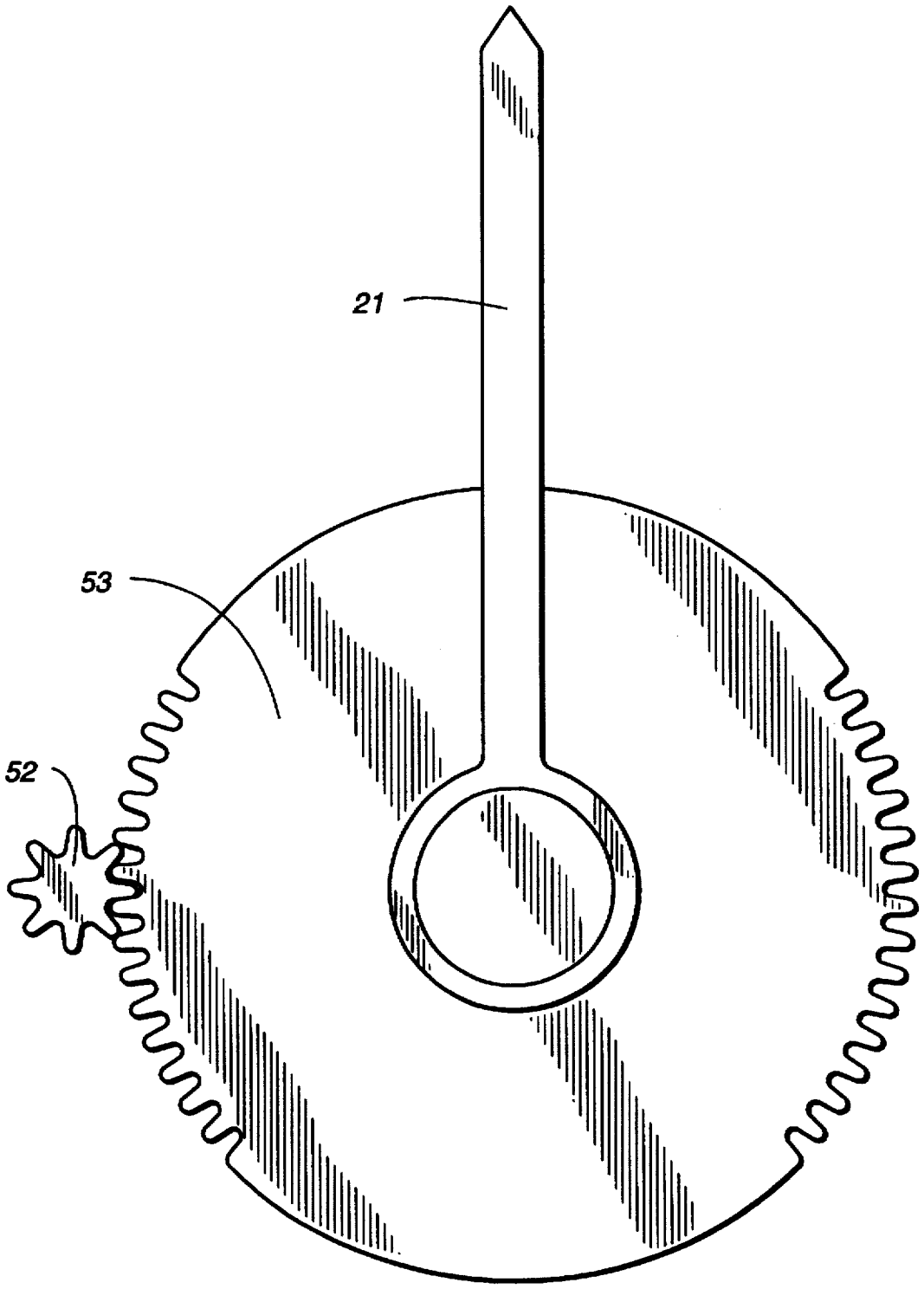
FIG. 8 is a plan view illustrating an atmospheric pressure tendency pointer and a measure indication wheel rotating together with the atmospheric pressure tendency pointer in the multifunctional electronic watch of FIG. 1.

First, after a 3-o'clock crown 16 is pulled out by two steps, a CPU, preferably implemented as a CMOS-IC, is initialized by pressing a 2-o'clock button 12 and a 10-o'clock button 13 simultaneously to reset the system, and then if the 2-o'clock button 12 is pressed, the small atmospheric pressure pointer 10 rotates in an opposite or counterclockwise direction. As shown in FIG. 8, measure indication wheel 53 comprises a pair of 15-tooth portions arranged symmetrically on right and left portions thereof. Additionally, the remaining portions do not have tooth formed thereon. Consequently, the part having no tooth causes the atmospheric pressure tendency pointer 21 to stop rotating at a fixed angle position. Therefore, after the output of contrarotation drive pulses from CPU-IC 40 finishes, the stop position of the atmospheric pressure tendency pointer 21 can be a standard to set the small atmospheric pressure pointer 10 in a zero point position.

Since the pointers move within a limited range of angles, they do not tend to interfere with supplementary pointers in a direction pointing to 6 o'clock, such as pointers displaying an alarm set time. Therefore, other supplementary pointers can be set at the same height position, and the height position of the pointers can be lowered. Consequently, as to the four pointers attached in the center position in this example, hour hand 1 and minute hand 2 can be set at the same height position as in a conventional multihead watch having three hands by setting atmospheric pressure tendency pointer 21 and an alarm hour hand 8 at the same height position from clockface 5.

Placement Structure of Sensor

Figure 9:
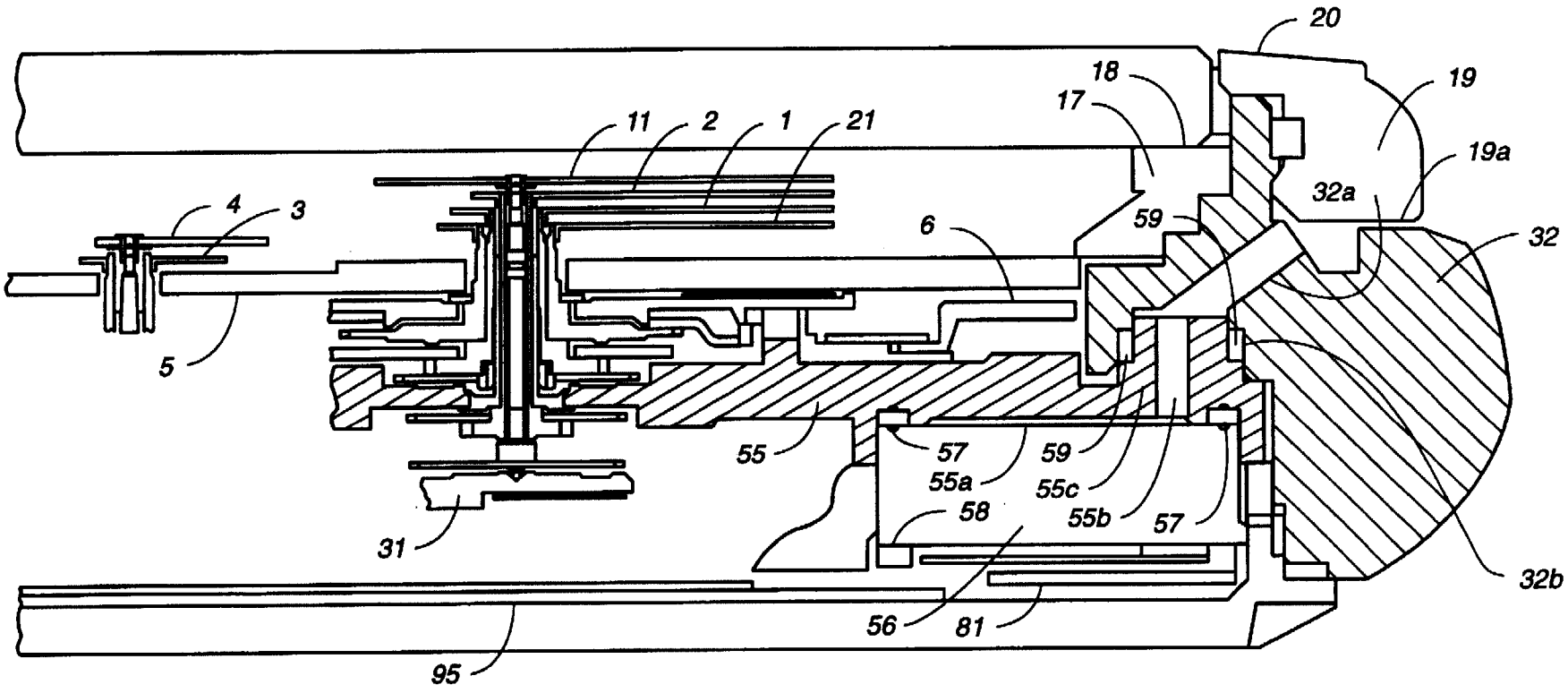
FIG. 9 is a partial cross-sectional view taken along the direction of the 2-o'clock illustrating a sensor in the multifunctional electronic watch of FIG. 1.

In FIG. 9, each component of the watch is supported by a base plate 55. The base plate 55 has a sensor containment portion **55*a* having a concave shape to attach a sensor in a position closer to the outer periphery, where a pressure sensor 56 is accommodated. In the sensor containment portion 55*a*, as shown in FIG. 2, the wheel trains and the step motors 24, 35, 54 and 47** are arranged in such a way as are deviated or offset with one another on a plane.

In FIG. 9, the sensor containment portion **55*a* has a first gasket 57 sandwiched between pressure sensor 56 and base plate 55. First gasket 57 is nipped between the pressure sensor 56 and the sensor containment portion 55*a* so as to secure waterproofness therebetween by fixedly securing a sensor press plate 58. Base plate 55 has a first through hole 55*b* leading from sensor containment portion 55*a* to the surface of base plate 55. First through hole 55*b* is formed closer to the outer periphery from the center of sensor containment portion 55*a*. First through hole 55*b* leads to a second penetration hole 32*a* formed obliquely on a cover case 32. On the outer surface of cover case 32, second through hole 32*a* is open below a rotational bezel 19, and there is a gap 19*a* between the rotational bezel 19 and the cover case 32. Thus, the sensing face of pressure sensor 56 communicating with the outside air through a minimally necessary passageway consisting of the through holes 55*b* and 32*a*. In such an arrangement, since rotational bezel 19 covers the outside opening of second through hole 32*a*, it is possible to prevent dust or foreign particles from entering the second through hole 32*a* and first through hole 55*b*. It is possible to cover the opening with a fixing frame of the watch body other than rotational bezel 19**.

In this example, first through hole **55*b* is formed in such a way as to penetrate a cartridge portion 55*c* of the base plate, and cartridge portion 55*c* is fitted into an extended or concave portion 32*b* of the second through hole 32*a* having a second gasket 59 fitted therein around. Second gasket 59 maintains waterproofness between base plate 55 and cover case 19**.

Thus in this example, because pressure sensor 19 is placed closer to the outer periphery of base plate 55, pressure sensor 19 can be arranged in such a way as not to overlap date wheel 6 and step motors 23, 35, 47 and 54. Since first through hole **55*b* is formed closer to the outer periphery of sensor containment portion 55*a*, second through hole 32*a* can also be formed distant from such parts as date wheel 6. Further, since sensor containment portion 55*a* is formed in such a way as not to overlap each of the wheel train and step motors 24, 35, 54 and 47 on a plane, base plate 55 and cover case 19 can be made thin. Moreover, a formation position of through holes 55*b* and 32*a* and sensor containment portion 55*a* can be secured without forming a raised portion on the outer periphery side of base plate 55 and cover case 19. Consequently, it is possible to form a thin watch body, and to realize a multifunctional electronic watch having a sensor W which has an excellent design such that the sensor containment portion 55*a* does not project from rotational bezel 19**.

Second Arrangement Of The Sensor

Figure 10:
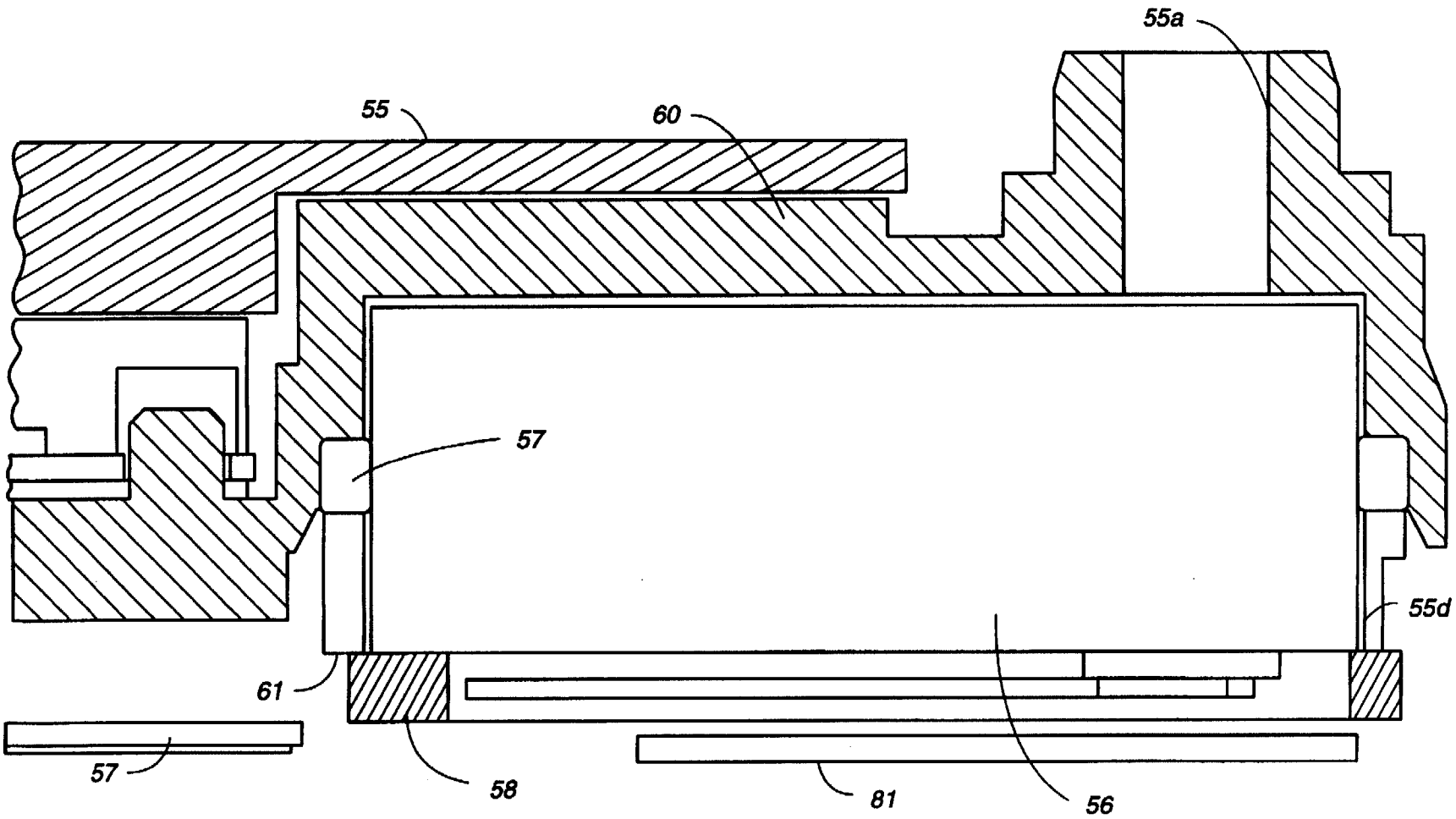
FIG. 10 is a partial cross-sectional view illustrating a different sensor from the sensor of FIG. 9.

Note that, as shown in FIG. 10, it is possible to construct a sensor containment portion **55*d* having base plate 55, sensor press plate 58 and a sensor frame 61, and to hold pressure sensor 56 between a circuit spacer 60 inside base plate 55 and sensor press plate 58. In this case, too, first through hole 55***a* can be formed in a position not overlapping, for example, date wheel 6 and step motors 23, 35, 47 and 54 by forming the first through hole 55*a* closer to the outer periphery of sensor containment portion 55*d*. Consequently, this arrangement is advantageous to form a thin multifunctional electronic watch.

Arrangement Of Electronic Parts

Figure 11:
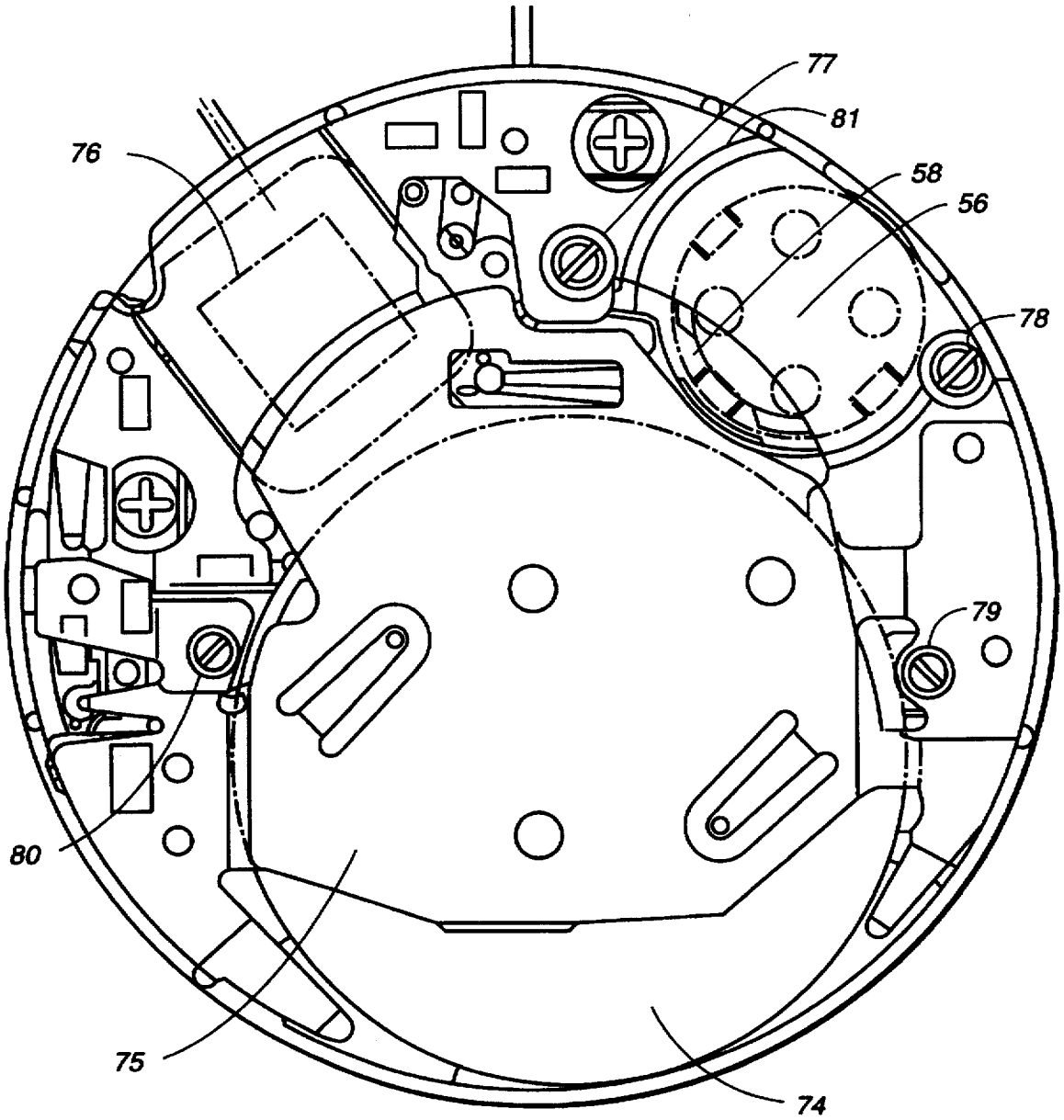
FIG. 11 is a rear view of the multifunctional electronic watch of FIG. 1 having a battery, an IC and a sensor.

As shown in FIG. 11, pressure sensor 56 has sensor press plate 58 fixedly secured by screws 77 and 78. Therefore, the first gasket 57 and the second gasket 59 are fixed securely to maintain a high degree of waterproofness In FIG. 11, pressure sensor 56 is completely protected by a circuit cover 81. Circuit cover 81 also covers an analog/digital or an A/D converter IC which converts analog signals of the pressure sensor 56 into digital signals. A battery 74 is secured in the watch by a battery press 75 which can be removed by screws 79 and 80. Since the pressure sensor 56, the A/D converter IC 76 and the battery 74 do not overlap with one another, this arrangement is advantageous to thin a multifunctional electronic watch with a sensor.

Control System

Figure 12:
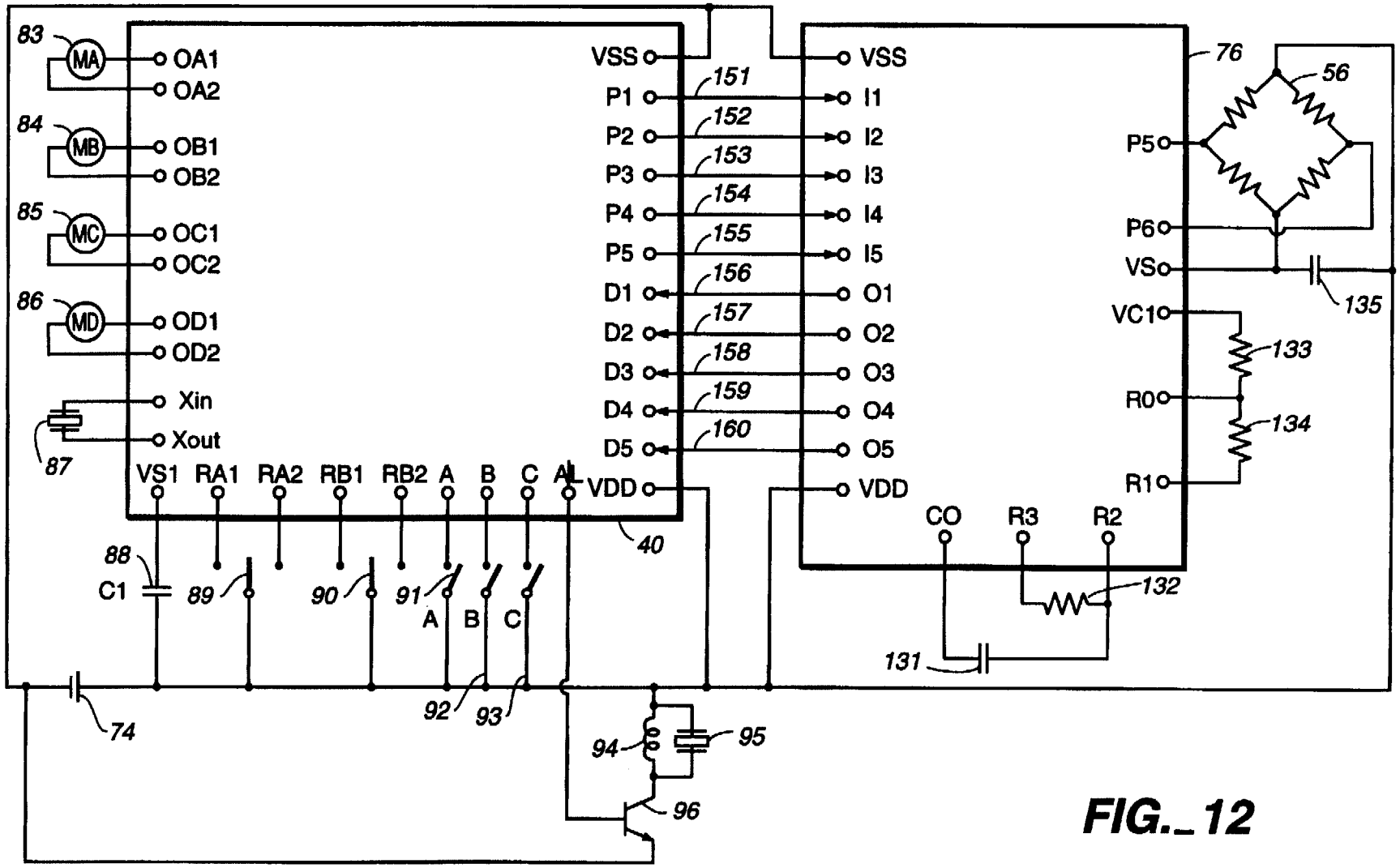
FIG. 12 is a schematic circuit diagram of the multifunctional electronic watch of FIG. 1.

FIG. 12 illustrates a schematic diagram of an electronic circuit of the multifunctional electronic watch in accordance with the present invention.

In this drawing, the electronic circuit system of the multifunctional electronic watch in this example generally consists of CPU-IC 40 to control the time indication system and the atmospheric pressure indication system, pressure sensor 56 implemented by, for example, a semiconductor sensor which can measure air pressure ranging from 500 hPa to 1050 hPa. Pressure sensor 56 utilizes a piezo-resistance effect of a piezo-resistance formed on a diaphragm. The electronic circuit also comprises A/D converter IC 76 for converting the measurements of the pressure sensor 56 into digital signals.

The CPU-IC 40 is preferably a microcomputer utilized in an analog electronic watch which has integrated, for example, a core CPU, a program memory, a motor driver and a motor pointer movement control circuit. A tuning fork type crystal oscillator 87 is tuned to a fundamental frequency of a built-in oscillation circuit, and a capacitor 88 preferably having a capacitance of 0.1 μF to control voltage variation of a built-in constant voltage circuit are also connected with CPU-IC 40. The status of the positions of 3-o'clock stem 16 and 4-o'clock stem 15 are input to the CPU-IC 40 through a switch 89 formed in part of a latch 63 and a switch 90 formed in part of an alarm pushing nail 68. Switch 89, interlocked to the movement of the first roll core 64, is electrically connected to a terminal RA1 when the 3-o'clock crown 16 is pulled out by one step or electrically connected to a terminal RA2 when the 3-o'clock crown 16 is pulled out by two steps.

Switch 90, interlocked to the movement of the second roll core 70, is electrically connected to a terminal RB1 when the 4-o'clock crown 15 is pulled out by one step or electrically connected to a terminal RB2 when the 4-o'clock crown 15 is pulled out by two steps. CPU-IC 40 further comprises switches 91, 92 and 93 interlocked with the operation of a 2-o'clock button 12, a 10-o'clock button 13 and an 8-o'clock button 14, respectively. Thus, when the 2-o'clock button 12, the 10-o'clock button 13 and the 8-o'clock button 14 are pushed each switch status is input to CPU-IC40. The CPU-IC 40 outputs control signals to a transistor 96 with a protective diode, and generates a confirmation alarm with a piezo-electric buzzer or an alarm sound. This is accomplished by energizing piezo-electric buzzer 95 and coil 94. These components are mounted on the back cover of the wristwatch case. Further, CPU-IC 40 outputs drive pulses to coil blocks 83, 84, 85 and 86 of each of the step motors 24, 35, 54, 47.

A/D converter 76 is implemented as an integral circuit and comprises a timing control circuit to perform dual integral, a preamplifier to amplify analog signals, and a constant voltage generation circuit to drive pressure sensor 56. A/D converter 76 is electrically connected to an integral capacitance 131 and an integral resistance 132. The preamplifier comprises resistances 133 and 134 and a capacitor 135 in the range of 0.1 μF to stabilize voltage of a constant voltage circuit are connected with the A/D converter IC 76.

CPU-IC 40 and A/D converter 76 are electrically connected by signal lines 151 to 155 and signal lines 156 to 159. Standard clock signals to control the A/D converter 76, comprising A/D converter start signals are output from CPU-IC 40 to A/D converter 76 through the signal lines 151 to 155. The A/D converter result is output from A/D converter I76 to CPU-IC 40 through the signal lines 156 to 159. Signals indicating that the A/D converter has been completed are output through a signal line 160. to CPU-IC 50

Architecture Of CPU-IC 40

Figure 13:
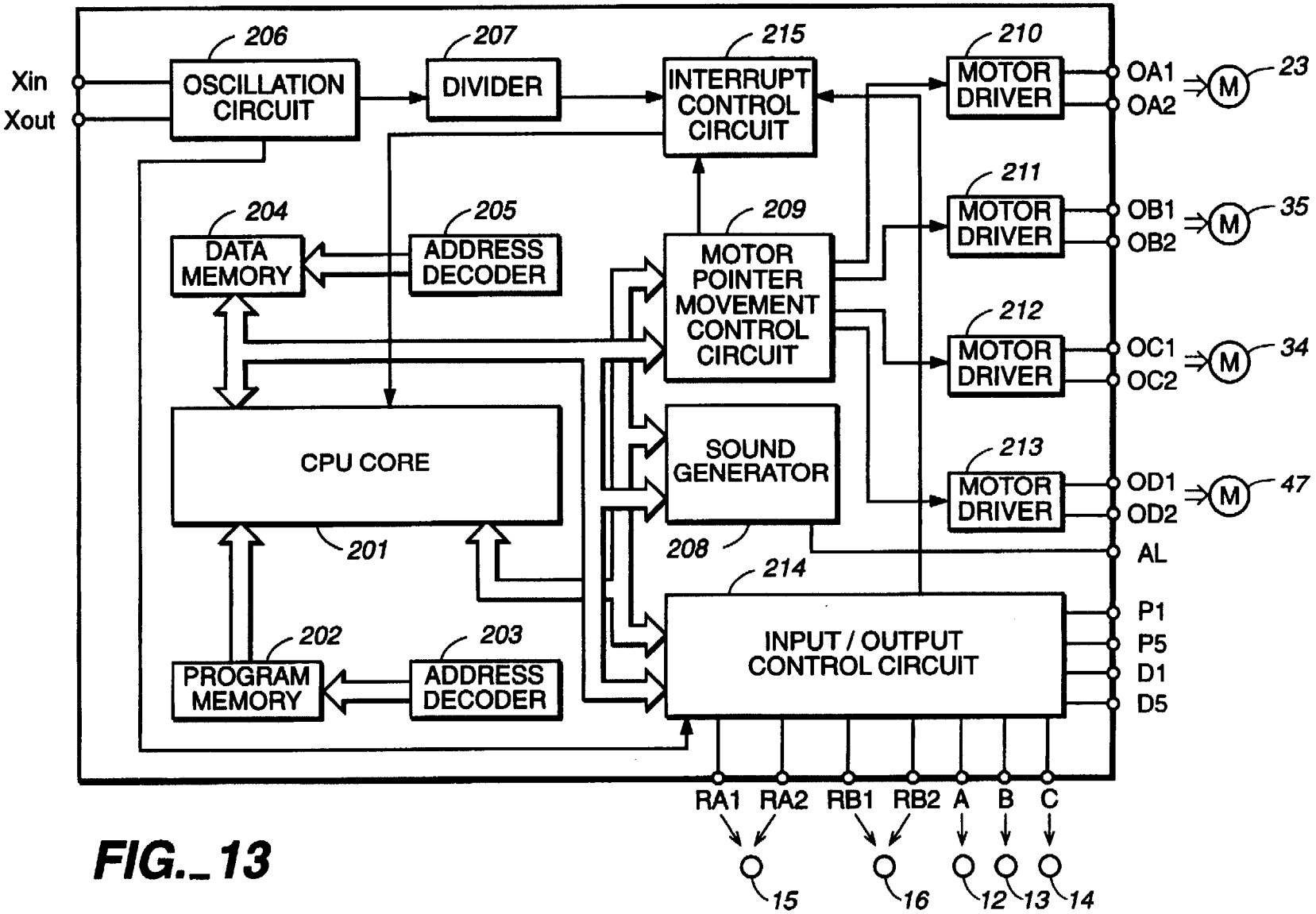
FIG. 13 is a functional block diagram of a CPU-IC of the multifunctional electronic watch with a sensor of FIG. 1.

FIG. 13 is a functional block diagram of CPU-IC 40. In FIG. 13, CPU-IC 40 comprises a core CPU 201 having an ALU or arithmetic and logic unit, an arithmetic register, a stack pointer, an instruction register, an instruction decoder, and is connected with peripheral circuits by an address bus and a data bus of a memory map I/O system. A program memory 202 is composed of a mask ROM, and has stored therein a software to operate a CPU-IC 40. The address of the program memory 202 is designated by an address decoder 203.

A data memory 204 is composed of RAM and its address is specified by an address decoder 205. The data memory 204 has, as shown in FIG. 14, a counter to record an atmospheric pressure value 603, an atmospheric pressure pointer position 604, a small atmospheric pressure pointer position 605, a present position of an atmospheric pressure pointer 606, a present position of a small atmospheric pressure pointer 607, a differential between the atmospheric pressure pointer position and the present pointer position 608, a differential between the small atmospheric pressure pointer position and the present pointer position 609, alarm set time 610, atmospheric pressure three hours before 611, and a differential between present atmospheric pressure and atmospheric pressure three hours before 612, as well as a second counter 601 and an hour and minute counter 602. In this example, the core CPU 201 functions as a change amount detection means to calculate an atmospheric pressure differential 612 (change amount of environmental data).

Referring again to FIG. 13, an oscillation circuit 20 oscillates at 32768 Hz with the tuning fork type crystal oscillator 87 connected with terminals XIN and XOUT as a fundamental oscillation. A signal having a frequency of 32768 Hz output from the oscillation circuit 20 are divided into signals having a frequency of 1 Hz via a divider or division circuit 207. A sound generator 208 forms buzzer drive signals based on an instruction from the core CPU 201 and outputs the signals to a terminal AL. An interrupt control circuit 215 is connected with the division circuit 207, a motor pointer movement control circuit 209, and an input-output control circuit 211, and outputs timer interrupt, motor control interrupt and key interrupt to the core CPU 201.

The motor pointer movement control circuit 209 generates a forward rotational drive pulse, a contrarotation drive pulse and an adjustment drive pulse, and outputs the pulses to motor drivers 210 to 213 in A series to D series. These motor drivers 210 to 213 output the forward rotational drive pulse, the contrarotational drive pulse and the adjustment drive pulse generated in the motor pointer movement control circuit 209 to corresponding step motors 23, 35, 54 and 47 in A series to D series, respectively.

An input-output control circuit 214 controls terminals A to C corresponding to switches 91 to 94 of the 2-o'clock button 12, the 10-o'clock button 13 and the 8-o'clock button 14, terminals RA1 and RA2 corresponding to a switch 89 of the 3-o'clock crown 16, terminals RB1 and RB2 corresponding to a switch 90 of the 4-o'clock crown 15, input terminals D1 to D5, and output terminals P1 to P5. And the input-output control circuit 214 is connected with an oscillation circuit 206, and outputs 32768 Hz clock signals to the output terminal P1 based on an instruction from the core CPU 201.

Converter

Figure 15:
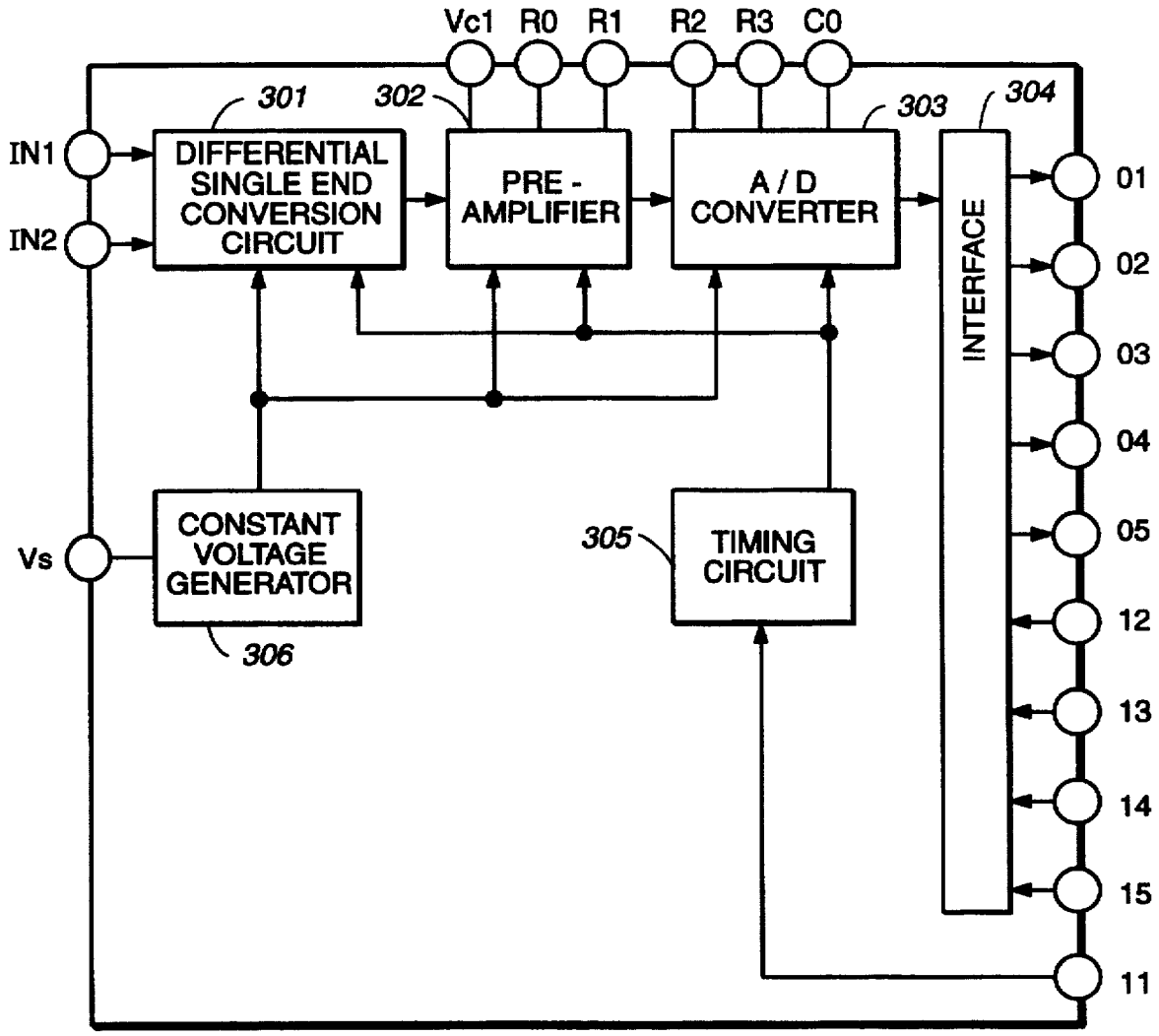
FIG. 15 is a block diagram illustrating an A/D converter IC of the multifunctional electronic watch of FIG. 1.

FIG. 15 is a block diagram showing the function of the A/D converter IC 76. In the drawing, a constant voltage generation circuit 306 generates voltage Vs to drive a pressure sensor 56 and reference voltage at each level required for the A/D converter. When the pressure sensor 56 is driven, voltage corresponding to pressure is generated, which is input through input terminals IN1 and IN2. Differential input voltage input from the input terminals IN1 and IN2 is converted into potential difference to standard voltage in a differential-single end conversion circuit 301. Analog signals indicating the potential difference are amplified several times or tens of times by a preamplifier 302. The amplification rate is determined by the ratio of resistance value of resistances 133 and 134 connected with terminals VC1, R0 and R1. Therefore, the resistance value of the resistances 133 and 134 is set up considering digital signals with which level of resolving power are the analog signals input from the input terminals IN1 and IN2 converted into. An A/D converter 303 is used with an integral resistance 132 and an integral capacitor 131 connected with terminals R3, R2 and C0. In actual operation, the condition of the A/D converter 303 is divided into positive integral time and negative integral time in time sequence, and positive integral time is controlled by a timing control circuit 305. The result of the A/D converter is stored in 12 bits, and one of three 4-bit data divided by 4 bits is output from output terminals O1, O2, . . . based on control signals input from the CPU-IC 40 through input terminals 12 and 13. Such a multiplexer and so on constitute an interface circuit 304.

Pointer Movement Operation

An indication operation of time and an atmospheric pressure value performed by a drive system and a control system constituted as described above will be explained with reference to FIG. 16.

Figure 16:
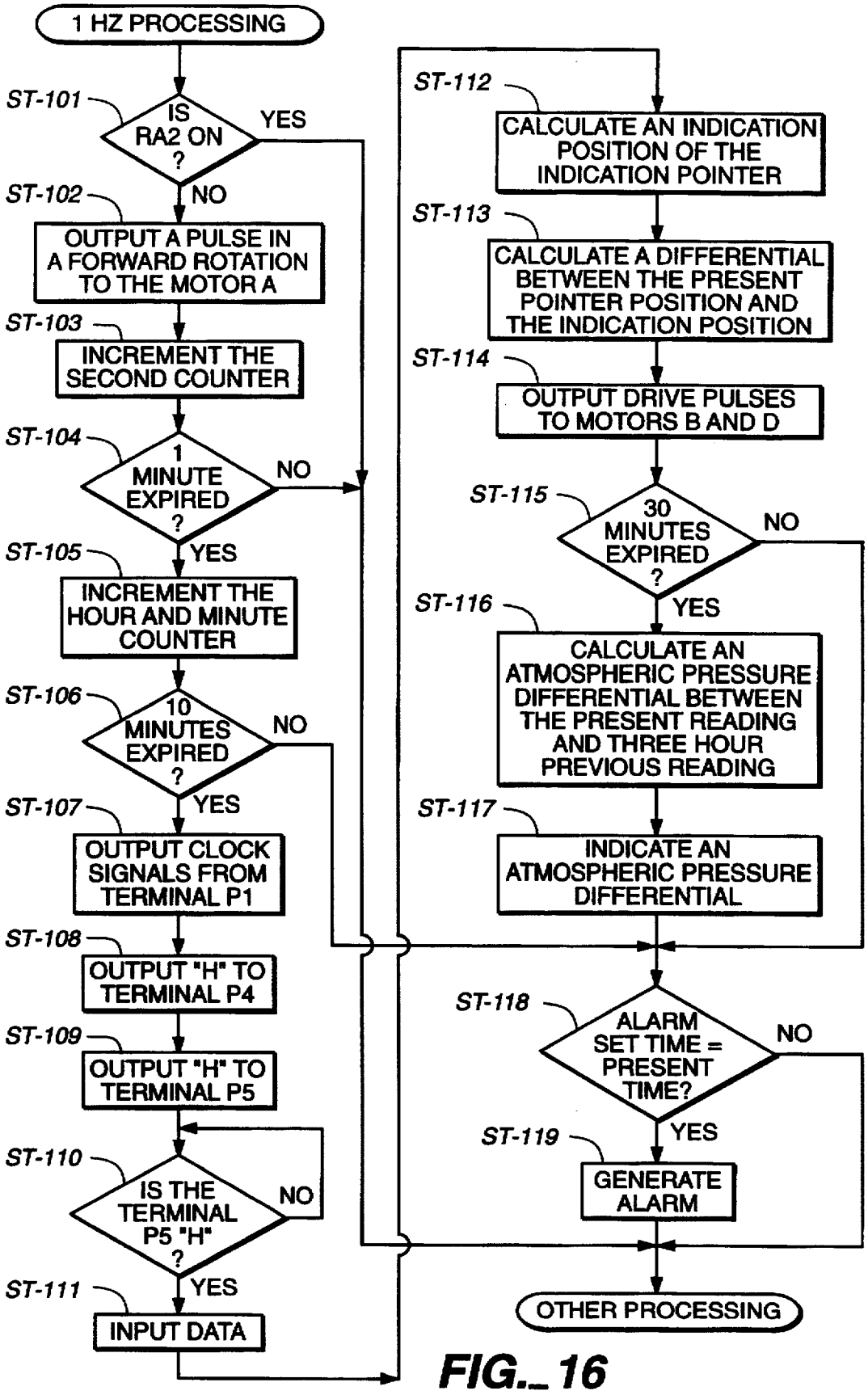
FIG. 16 is a flow chart illustrating a basic operation of the multifunctional electronic watch of FIG. 1.

FIG. 16 is a flow chart showing the indication operation of the multifunctional electronic watch with a sensor in this example. Note that the operations described below are done with both of the 3-o'clock crown 16 and the 4-o'clock crown 15 pushed to a normal condition.

First, if there is timer interrupt of 1 Hz at step ST 101, it is judged whether the terminal RA2 is OFF or not, that is, the 3-o'clock crown 16 is pulled out by two steps or not. If it is judged that the 3-o'clock crown 16 is not pulled out by two steps, at step ST 102, the core CPU 201 outputs an instruction to output a forward rotational drive pulse to the motor pointer movement control circuit 209, while the motor driver 210 in A series outputs a forward rotational drive pulse to the step motor 23 in A series. As a result, the step motor 23 rotates by 180 degrees in the forward direction, which causes the small second hand 3 to rotate 6 degrees in the clockwise direction (forward rotational direction) to indicate the second. The minute hand 2, the hour hand 1 and the 24-hour hand 4 move forward interlocked to the small second hand 3 through the wheel train.

The measurement of atmospheric pressure and the indication will be performed as described below.

After timer interrupt of 1 Hz, at step ST 103, "1" is added to a second counter 601. At step ST 104 it is judged if there is a carry of minute, and if there is, at step ST 105 "1" is added to an hour and minute counter 602.

At step ST 106, it is judged if time is fully 10 minutes, if it is judged yes, the measurement of atmospheric pressure and the indication are performed thereafter.

In a treatment of the measurement of atmospheric pressure, first at step ST 107 clock signals of 32768 Hz are output from the terminal P1, and then at step ST 108 to step ST 109 the output terminals P2 to P5 are set at logically "H" level successively. Based on this conversion, the detection result of the pressure sensor 56 (analog signals) is digitized by the A/D converter IC 76, after which an output terminal O5 of the A/D converter IC 76 is set at "H" level. Since the output terminal O5 is connected with an input terminal D5 of the CPU-IC 40, the output terminal O5 waits until the input terminal D5 reaches an "H" level at step ST 110.

If the input terminal D5 reaches an "H" level, at step ST 111 the CPU-IC 40 receives the result of the A/D converter of the atmospheric pressure measurement value from the input terminals D1 to D4, selecting data from the output terminals P4 and P5. At step ST 112, the core CPU 201 calculates an atmospheric pressure value 603 by adding and multiplying a constant to the result of the A/D converter. At step ST 113, the core CPU 201 calculates a pointer position 604 of the atmospheric pressure pointer 11, and also calculates the differential 608 of the position 604 from the present pointer position 606. At the same time, the core CPU 201 calculates a pointer position 605 of the small atmospheric pressure pointer 10, and calculates a differential 609 of the position 605 from the present pointer position 607. At step ST 114, when the differentials of pointer positions 608 and 609 are positive, the forward rotational drive pulses are output from the motor drivers 211 and 213 in B series and D series by the number corresponding to the differentials 608 and 609, and when the differentials of pointer positions 608 and 609 are negative, contrarotation pulses are output in the same way. As a result, the atmospheric pressure pointer 11 and the small atmospheric pressure pointer 10 rotate to a fixed position to indicate the measured atmospheric pressure value.

If the timing is fully 30 minutes at step ST 115, a differential 612 of an atmospheric pressure value measured three hours before 611 from a value measured this time 603 is calculated at step ST 116, and a step motor in D series is driven by a required number of pulses at step ST 117. As a result, the atmospheric pressure tendency pointer 21 rotates to a fixed position to indicate an atmospheric pressure differential 613.

Note that after it is judged that there is a carry of minute at step ST 104, if it is judged that the timing is not fully 10 minutes at step ST 106, or after it is judged that the timing is not fully 30 minutes at step ST 115, at step ST 118 an alarm set time 610 stored in the data memory 104 and the present time 602 are compared. If the alarm set time 610 and the present time 602 coincide, the sound generator 208 outputs alarm generation instruction signals by an instruction from the core CPU 201 to drive a transistor 96 and produce an alarm. Subsequently, another operations are carried out until there occurs a next interrupt.

Example 2

Example 2 according to the present invention will be described below. Note that since a multifunctional electronic watch with a sensor in this example has a basic constitution similar to that of the multifunctional electronic watch with a sensor in Example 1, the same symbols are denoted to the corresponding elements, and the description will be omitted.

In this example, as shown in FIG. 17, a data memory 204 of a CPU-IC 40 stores the lowest atmospheric pressure 613, an atmospheric pressure correction mode 614 and battery life 615 as well as a second counter 601, an hour and minute counter 602, an atmospheric pressure value 603, an atmospheric pressure pointer position 604, a small atmospheric pressure pointer position 605, a present position of the atmospheric pressure pointer 606, a present position of the small atmospheric pressure pointer 607, a differential of the atmospheric pressure pointer position from the present pointer position 608, a differential of the small atmospheric pressure pointer position from the present pointer position 609, alarm set time 610, atmospheric pressure three hours before 611, and a differential of the present atmospheric pressure from the atmospheric pressure three hours before 612.

Figures 18, 18A, 18B:
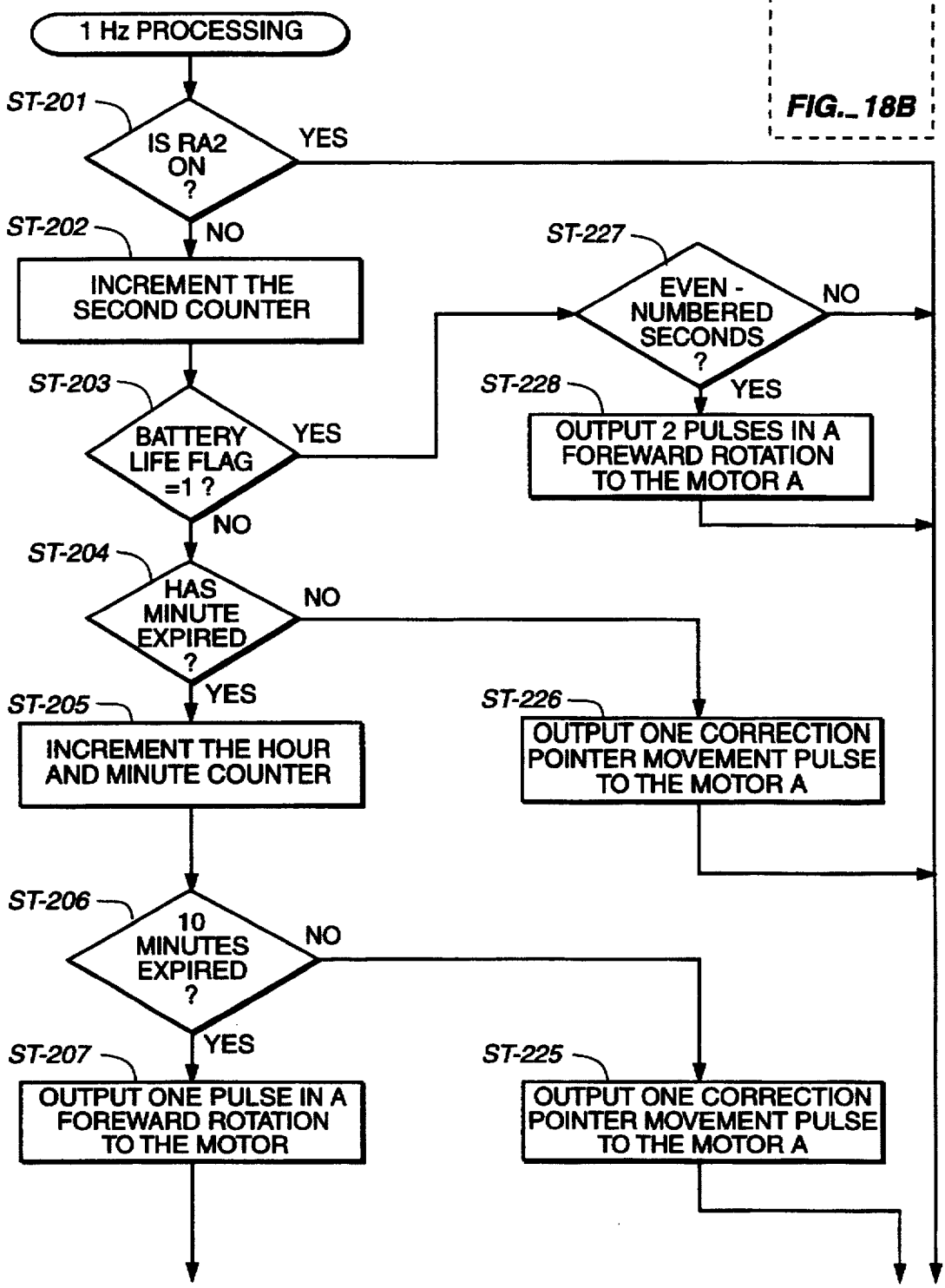
FIG. 18, comprising
FIGS. 18A and 18B, is a flow chart illustrating a basic operation of the multifunctional electronic watch of the second embodiment.
Figure 18B:
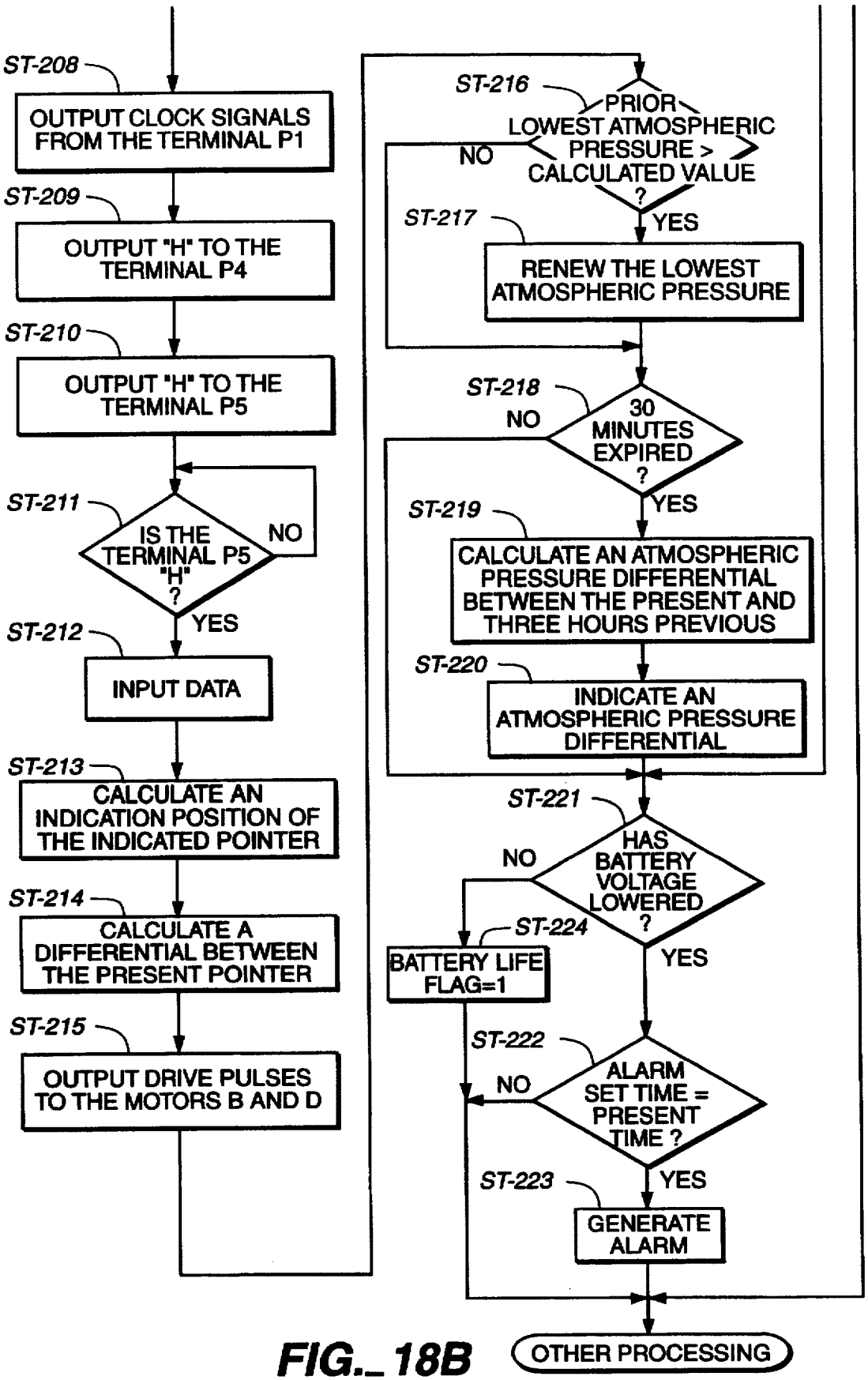

The operation performed in the multifunctional electronic watch with a sensor in this example will be described below with reference to FIG. 18. FIG. 18 is a flow chart showing an indication operation of the multifunctional electronic watch with a sensor in this example.

When a 1 Hz timer interrupt occurs, at step ST 201 it is judged whether the terminal RA2 is OFF or not, that is, whether the 3-o'clock crown 16 is pulled out by two steps or not. If the 3-o'clock crown 16 is not pulled out by two steps, "1" is added to the second counter 601 of the data memory 204 at step ST 202 in order to count the present time. Next, at step ST 203 it is judged whether a flag to indicate that a battery life indication is executed to the data memory 204 is "1" or "0". If the flag is "1", it means that battery life is expiring, and a pointer is put forward for two steps every two seconds to inform the user that battery life is expiring. If the flag is "0", on the other hand, the pointer is put forward as usual.

In a normal pointer movement, it is judged whether a minute carry is occurred or not at step ST 204, and if it is judged yes, after "1" is added to the hour and minute counter 602 at step ST 205, it is judged whether time is fully ten minutes or not at step ST 206. If it is judged that time is fully ten minutes, a forward rotational pulse is output to the step motor at step ST 207, and the following measurement and indication of atmospheric pressure will be performed. The forward rotational pulse in this case drives a pointer with a large torque to execute a pointer movement in a short time so that time in which to perform the A/D converter done later can be secured.

In a processing of atmospheric pressure measurement, after the 32768 Hz clock signal is output from an output terminal P1 at step ST 208, output terminals P2 to P5 are set to be at "H" level successively at steps ST 209 and ST 210. After A/D converter is finished in the A/D converter IC 76, since an output terminal O5 of the A/D converter IC 76 is at "H" level, the CPU-IC 40 waits at step ST 211 till an input terminal D5 becomes "H" level.

When the input terminal D5 is set "H" level, the CPU-IC 40 receives the A/D converter result of the atmospheric pressure measurement value from input terminals D1 to D4 selecting data from output terminals P4 and P5 at step ST 212. At step ST 213, the core CPU 201 calculates the atmospheric pressure value 603 by adding and multiplying a constant to the A/D converter result. At step ST 214, the differentials 608 and 609 from the present pointer position 606 and 607 are calculated by calculating the pointer positions 604 and 605 of the atmospheric pressure pointer 11 and the small atmospheric pressure pointer 10. At step ST 215, when the pointer position differentials 608 and 609 are positive, a forward rotational drive pulse is output from motor drivers 211 and 212 in B series and D series by the number of pulses corresponding to the differentials 608 and 609, and when the differentials 608 and 609 are negative, a reverse rotational pulse is output in the same way. As a result, the atmospheric pressure pointer 11 and the small atmospheric pressure pointer 10 rotate to a fixed position to indicate a measured atmospheric pressure value.

Then at step ST 217, if the measurement value this time is smaller than the lowest atmospheric pressure 613 that has been measured in the past stored in the data memory 204, the content of the lowest atmospheric pressure 613 is changed to the measurement value this time.

At step ST 218, it is judged whether the timing is fully 30 minutes or not, and if it is fully 30 minutes, at step ST 219 the differential 612 between an atmospheric pressure measurement value three hours before 611 and a measurement value this time 603 is calculated. At step ST 220 a required number of pulses are output to drive a step motor 47 in D series. As a result, the atmospheric pressure tendency pointer 21 indicates the atmospheric pressure differential in a fixed position.

If the measurement value this time is higher than the lowest atmospheric pressure 613 that has been measured in the past stored in the data memory 204 at a step ST 216, it is judged whether the timing is fully 30 minutes or not at step ST 218 without renewing the content of the lowest atmospheric pressure 613.

Then at step ST 221 it is judged whether battery voltage has lowered or not, and if battery voltage has not lowered, at step ST 222 alarm set time and the present time are compared. If the present time and the alarm set time coincide, at step ST 223 after an alarm is produced, another treatment is performed. On the other hand, if it is judged that battery life is expiring at step ST 221, after a flag "1" is set, another operation is carried out without producing an alarm.

In this example, when it is judged that the carry of minute is not occurred at step ST 204, a correction pointer movement pulse is output once to the step motor in A series at step ST 225, and then an operation is performed. Similarly, when it is judged that time is not fully ten minutes at step ST 206, a correction pointer movement pulse is output once to the step motor in A series at step ST 226, and then another operation is performed. In these cases, the atmospheric pressure measurement is not carried out. In the way of moving the pointer here saves consumed electricity by moving the pointer with a small torque compared with the pointer movement in measuring atmospheric pressure. That is, a means to change the way of moving the pointer is constituted which changes the way of moving the time indication pointer between the data measurement period of the pressure sensor 56 and its pause period. Accordingly, if the correction drive method is adopted in an analog electronic watch with a sensor or in an analog-digital electronic watch, it is possible to secure enough time required to digitize the measurements of the sensor by performing the pointer movement in the measurement period of the pressure sensor 56 in a short time.

If it is judged that battery life is expiring at step ST 203, a pointer movement is performed in order to inform the user that battery life is expiring. That is, if it is judged at step ST 227 that time is not even seconds, another operation is performed without moving the pointer. On the other hand, if it is judged at step ST 227 that time is even seconds, two forward rotational pulses (for two seconds) are output at step ST 228, and then another operation is performed. Thus, the pointer is put forward by two steps every two seconds, it is possible to inform the user that battery life is expiring. Note that atmospheric pressure is not measured in this case.

Thus the watch in this example has a power source voltage detection means to observe power source voltage to the operation timing of the alarm means constituted as an additional function drive means, and a drive control means to change the way of moving a pointer based on the observation result. Accordingly, it is possible to observe power source voltage and to properly control power source voltage without installing a special counter means to control only timing to observe power source voltage.

In this example, because the watch has a backlash prevention means to rotate the atmospheric pressure pointer 11 according to the flow chart shown in FIG. 19 in outputting pulses to a step motor 35 in B series, no difference in indication occurs owing to backlash.

Backlash by the first middle wheel for atmospheric pressure indication 37, the second middle wheel for atmospheric pressure indication 38 and the atmospheric pressure indication wheel 39 corresponds to one step of a drive pulse.

In FIG. 19, after a drive pulse is output to the step motor 35 in B series and the step motor 47 in D series at step ST 301, the indication point this time by the step motor 35 in B series and the present indication position are compared at step ST 303. When it is judged that the indication point this time is bigger than the present indication point, it is judged whether the last pointer movement direction by the step motor 35 is the forward rotational direction or not at step ST 303.

If it is judged that the last pointer movement is in the forward rotational direction at the step ST 303, the position this time is indicated by driving the step motor 35 at step ST 304. That is, drive pulses in the forward rotational direction of the number corresponding to the differential between the indication position this time and the last indication position are output to the step motor 35.

On the other hand, if it is judged that the last pointer movement is in the reverse rotational direction at the step ST 303, drive pulses in the forward rotational direction of the number corresponding to the differential between the indication position this time and the last indication position plus one are output to the step motor 35 at step ST 305. Consequently, backlash of the first middle wheel for atmospheric pressure indication 37, the second middle wheel for atmospheric pressure indication 38 and the atmospheric pressure indication wheel 39 is corrected, and the atmospheric pressure pointer 11 indicates an atmospheric pressure value without indication difference.

If it is judged that the indication position this time is bigger than the present indication position at step ST 302, the indication position this time by the step motor 35 in B series and the present indication position are compared at step ST 310. If it is judged that the indication position this time is smaller than the present indication position, it is judged whether the pointer movement last time by the step motor 35 is in the reverse rotational direction or not at step ST 311. If it is judged at step ST 311 that the pointer movement last time by the step motor is in the reverse rotational direction, drive pulses in the forward rotational direction of the number corresponding to the differential between the indication position this time and the last indication position plus one are output to the step motor 35 at step ST 311. If it is judged at step ST 311 that the pointer movement last time by the step motor 35 is in the forward rotational direction, drive pulses in the reverse rotational direction of the number corresponding to the differential between the indication position this time and the last indication position plus one are output to the step motor 35 at step ST 313. Consequently, backlash is corrected in this case too, and the atmospheric pressure pointer 11 indicates an atmospheric pressure value without indication difference.

Then at step ST 306 it is judged whether the indication position this time by the step motor 47 in D series is bigger than the present indication position or not. If it is judged that the indication position this time is bigger than the present indication position, drive pulses of the number corresponding to the differential between the indication position this time and the last indication position in the forward rotational direction are output to the step motor 47 at step ST 307. On the other hand, if it is judged at step ST 306 that the indication position this time is not bigger than the present indication position, it is judged at step ST 308 whether the indication position this time is smaller than the present indication position or not. If it is judged at step ST 306 that the indication position this time is smaller than the present indication position, drive pulses of the number corresponding to the differential between the indication position this time and the last indication position in the reverse rotational direction are output to the step motor 47 at step ST 309.

If it is judged at step ST 310 that the indication position this time is not smaller than the present indication position, the step motor 47 is not driven regarding the two positions as the same.

Setting of Small Atmospheric Pressure Pointer and Atmospheric Pressure Tendency Pointer at Zero The process of setting the small atmospheric pressure pointer 10 and the atmospheric pressure tendency pointer 21 at zero will be described below with reference to FIG. 20. This operation is performed by pressing the 2-o'clock button 12 and the 10-o'clock button 13 simultaneously with the 3-o'clock crown 16 pulled out by two steps when the zero position of the small atmospheric pressure pointer 10 and that of the atmospheric pressure tendency pointer 21 do not overlap.

Figure 20:
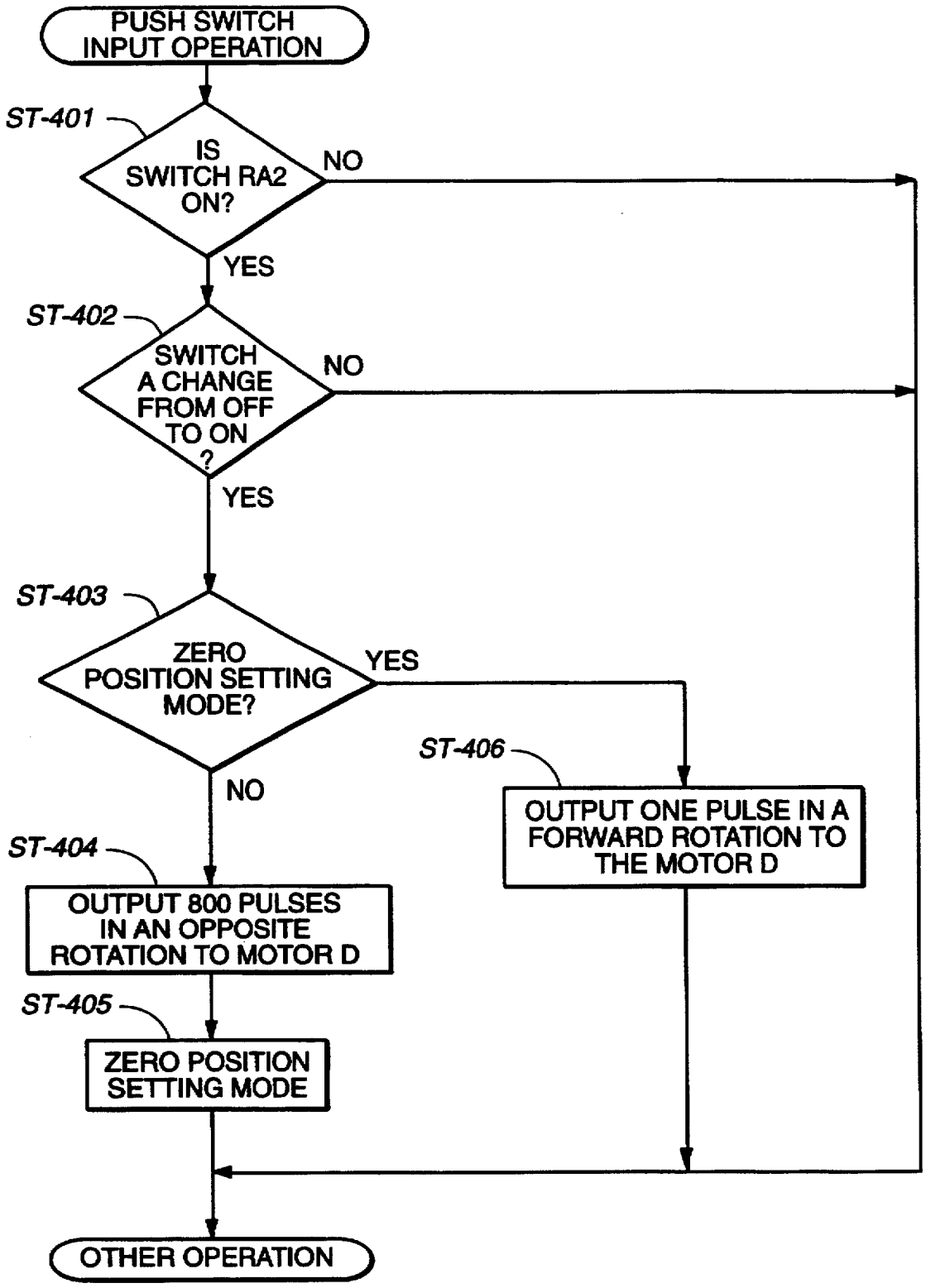
FIG. 20 is a flow chart of an adjustment operation in a zero position of a small atmospheric pressure pointer and an atmospheric pressure tendency pointer of the multifunctional electronic watch of the second embodiment.

In FIG. 20, it is judged at step ST 401 whether the 3-o'clock crown 16 is pulled out by two steps or not based on whether the terminal R2A is ON or not, and if it is judged that the terminal R2A is ON, it is judged at step ST 402 whether the terminal A has changed from OFF to ON. If it is judged that the 2-o'clock button 12 is pressed and the terminal A has changed from OFF to ON, it is judged at step ST 403 whether the watch is in a mode of setting at zero position or not.

If it is judged at step ST 403 that the watch is not in a mode of setting at zero position, 800 pulses in the reverse rotation are output to the step motor 47 in D series. The measurement indication wheel 53 of the atmospheric pressure tendency pointer 21, as was described before with reference to FIG. 8, has two pairs of 15-tooth formed portions symmetrically right and left, and also has a portion with no tooth formed. Accordingly, the small atmospheric pressure pointer 10 and the atmospheric pressure tendency pointer 21 stop in a position at the end of a portion with teeth formed. After the output of pulses, the watch gets in a mode of setting at zero at step ST 405.

Accordingly, after there is an interrupt again, if it is judged at step ST 403 that the watch is in a mode of setting at zero position, one pulse in the forward rotation is output to the step motor 47 to adjust the 0 position of the atmospheric pressure tendency pointer 21 at step ST 406.

Figure 21:
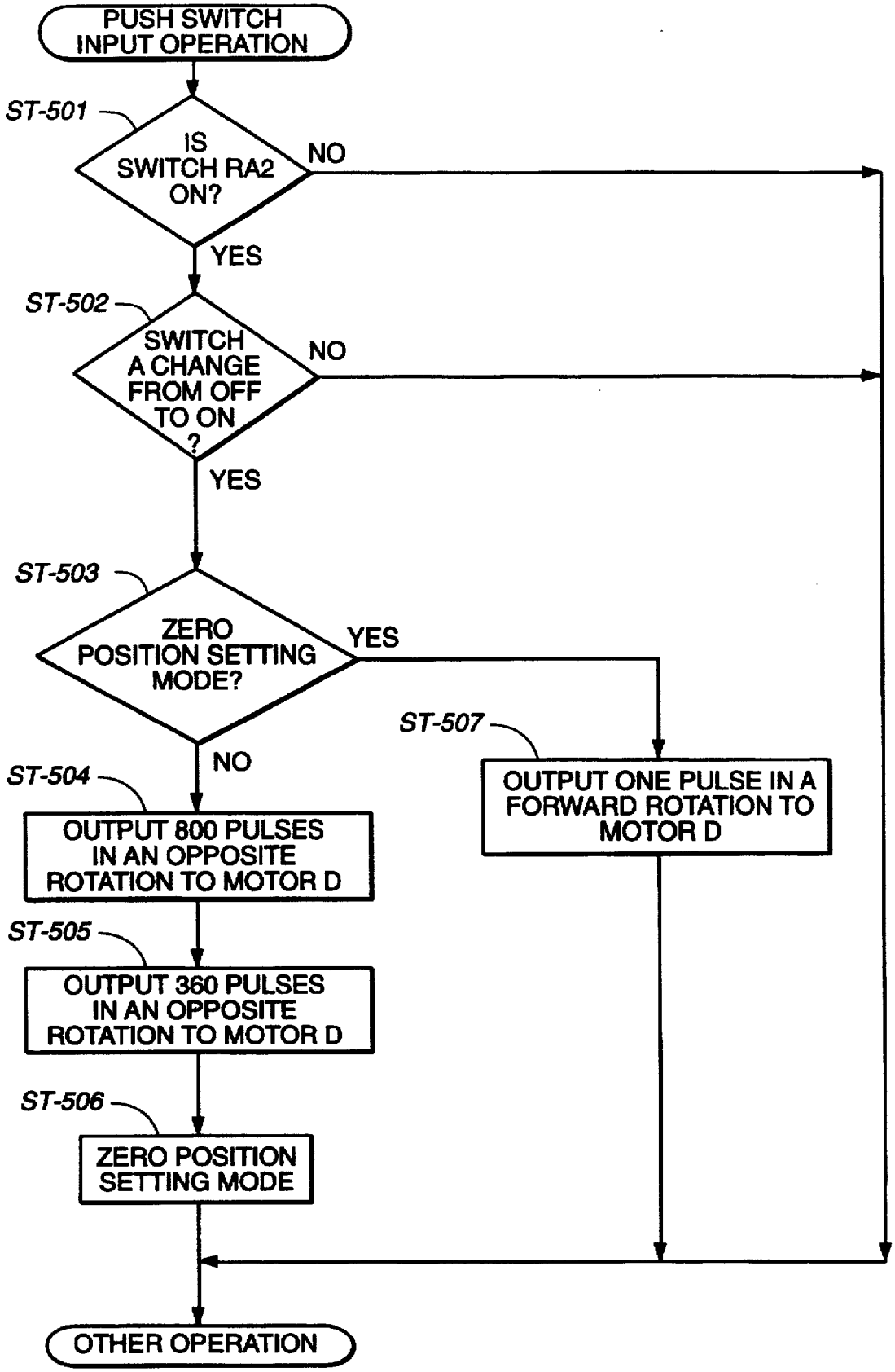
FIG. 21 is a flow chart illustrating another example of an adjustment operation in a zero position.

Note that it is possible to perform zero positioning in a short time by performing this operation based on the flow chard shown in FIG. 21 instead of the flow chart shown in FIG. 20.

In FIG. 21, it is judged at step ST 501 whether a terminal R2A is ON or not, and if it is judged that the terminal is ON, it is judged at step ST 502 whether the 2-o'clock button 12 has been pressed or not. If it is judged that the 2-o'clock button 12 has been pressed, it is judged at step ST 503 whether the watch is in the zero positioning mode or not.

If it is judged that the watch is not in the zero positioning mode, 800 pulses in the reverse rotation are output to the step motor 47 in D series to rotate the atmospheric pressure tendency pointer 21 in the opposite direction (counterclockwise direction) at step ST 504. Because the atmospheric pressure tendency pointer 21 has tooth forms only in its part, the small atmospheric pressure pointer 10 and the atmospheric pressure tendency pointer 21 stop at the end of the portion where tooth forms are formed. Thereafter, 360 pulses in the forward rotation are output to the step motor 47 to rotate the atmospheric pressure tendency pointer 21 clockwise at step ST 505. As a result, the atmospheric pressure tendency pointer 21 has stopped before the 0 position, and when the output of pulses finishes at step ST 506, the watch is in the zero positioning mode.

Thereafter, if there is an interrupt, and if it is judged at the step ST 503 that the watch is in the zero positioning mode, one pulse in a forward rotation is output to the step motor 47 at step ST 507. As a result, the atmospheric pressure tendency pointer 21 has already stopped before the zero position, the pointer 21 is set in the zero position by pulses in the forward rotation.

Thus, because the watch in this example has a pointer position adjustment means which stops the rotation of the pointer making use of the portion where no tooth is formed, and which then adjusts the pointer position with the stop position as a standard, the pointer position can be adjusted easily and correctly.

Call Operation of Lowest Atmospheric Pressure

The operation to indicate the lowest of the measured atmospheric pressure value will be described below with reference to FIG. 22.

Figure 22:
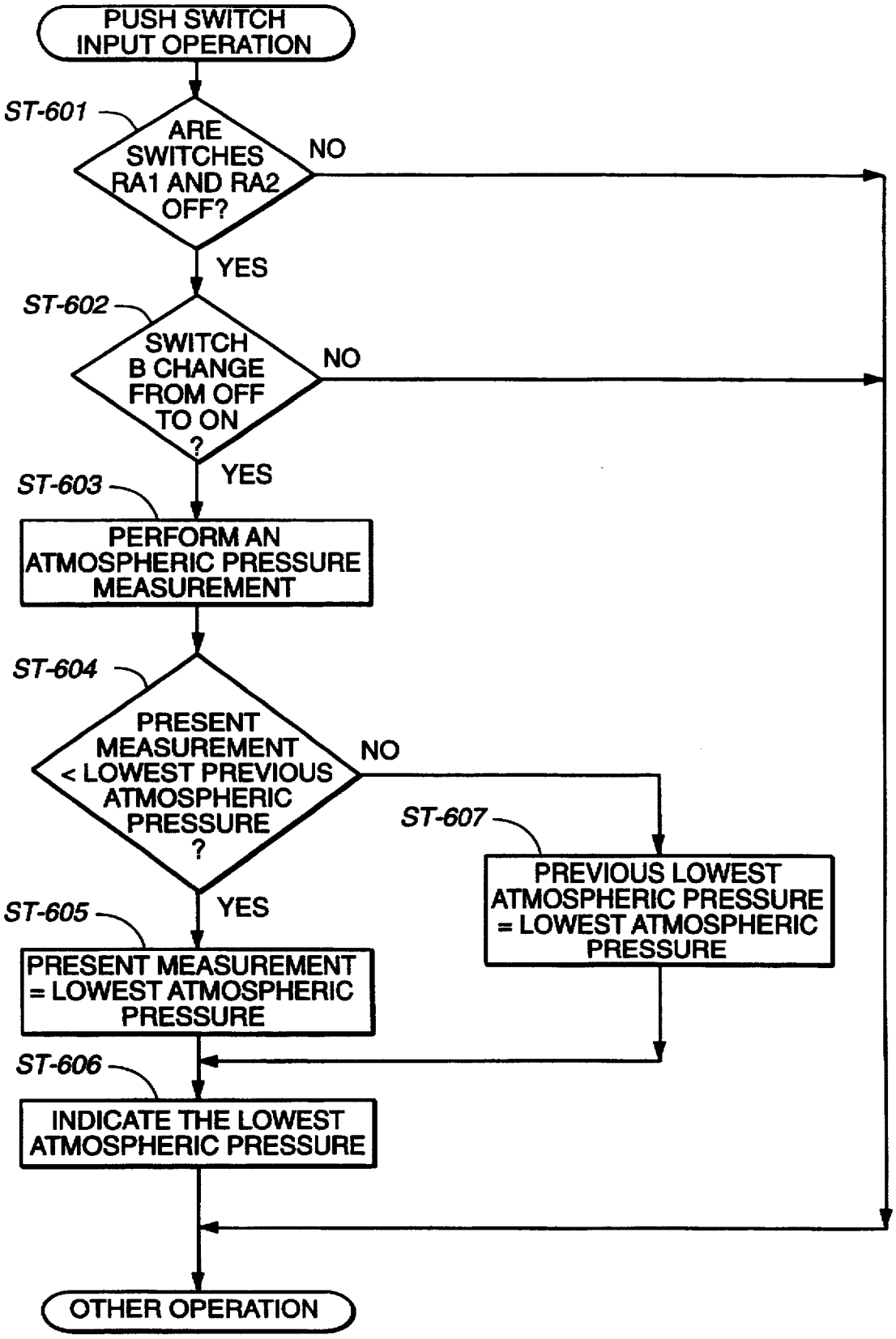
FIG. 22 is a flow chart illustrating an indication operation of the lowest atmospheric pressure value in the multifuinctional electronic watch of the second embodiment.

In FIG. 22, it is judged at step ST 601 whether terminals RA1 and RA2 are OFF, that is, whether the 3-o'clock crown 16 is in a normal position. If it is judged that the 3-o'clock crown 16 is in a normal position, it is judged at step ST 602 whether the 10-o'clock button 13 (B switch) has been pressed. If it is judged at step ST 602 that the 10-o'clock button 13 has been pressed, at step ST 603 atmospheric pressure is measured once, and the measurement value is compared with the lowest atmospheric pressure 613 of the data memory 204, which is the lowest of the measurements that have been measured every ten minutes.

If the measurement value this time is the lowest atmospheric pressure, after the measurement value this time is written in the lowest atmospheric pressure 613 of the data memory 204, the lowest atmospheric pressure 613 is indicated at step ST 606. Thus, since the watch in this example has a specific data renewal means to renew the lowest atmospheric pressure 613 (specific data) immediately before the indication, it is possible to indicate information based on the latest data.

On the other hand, if the measurement value this time is bigger than the lowest atmospheric pressure value measured so far, the lowest atmospheric pressure 613 is indicated as it is at step ST 606.

Operation to Calibrate Atmospheric Pressure Pointer

The operation to calibrate an atmospheric pressure measurement value will be described with reference to FIG. 23. This operation is performed, for example, to adjust an atmospheric pressure reference device and so on when there is a deviation in an atmospheric pressure value. Concretely, this operation is performed by pressing both of the 2-o'clock button 12 and the 10-o'clock button 13 with the 3-o'clock stem 16 pulled out by one step.

Figure 23:
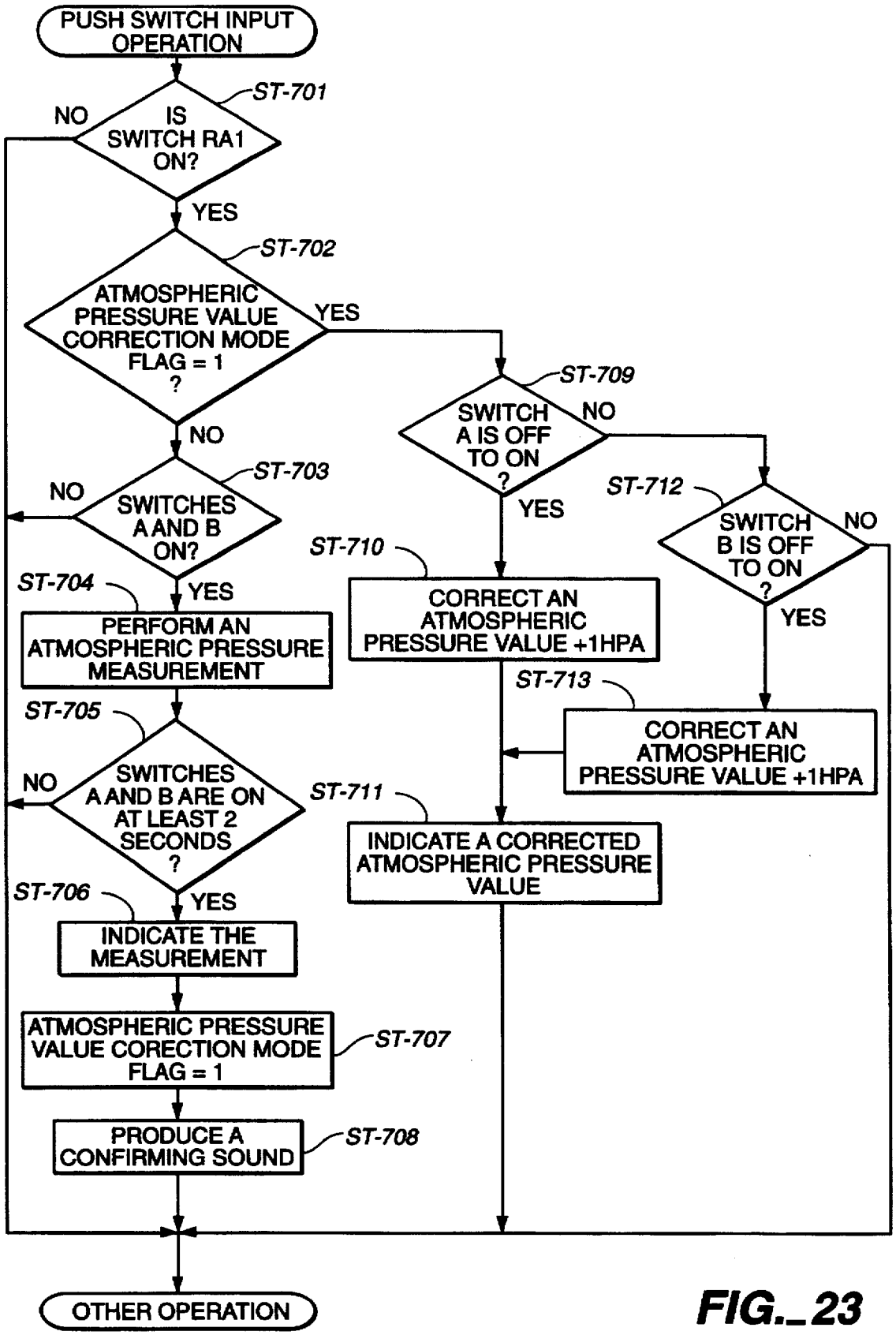
FIG. 23 is a flow chart illustrating a calibration operation of the indication in the multifunctional electronic watch of the second embodiment.

In FIG. 23, it is judged at a step ST 701 whether a terminal RA1 is ON or not, that is, whether the 3-o'clock crown 16 is pulled out by one step or not. If it is judged that the terminal RA1 is ON, it is judged at step ST 702 whether the watch is in an atmospheric pressure value correction mode or not. The judgment is made based on whether a flag of the data memory 204 is "0" or not, and if the flag of the data memory 204 is "0", it is judged that the watch is not in the atmospheric pressure value correction mode.

If it is judged that the watch is not in the atmospheric pressure value correction mode, and it is also judged at step ST 703 that both of the 2-o'clock button 12 (A switch) and the 10-o'clock button 13 (B switch) are pressed simultaneously, atmospheric pressure is measured at step ST 704. Next, if it is judged at step ST 705 that the 2-o'clock button 12 (A switch) and the 10-o'clock button 13 (B switch) are pressed more than two seconds, the measurement value is first indicated at step ST 706. Then at step ST 707, in order to adjust the atmospheric pressure value, after "1" is written in the flag of the data memory 204, an alarm to that effect is produced at step ST 708.

Thereafter, if there is an interrupt, and it is judged at step ST 702 that the watch is in an atmospheric pressure correction mode, and also it is judged at step ST 709 that the 2-o'clock button 12 (A switch) has been pressed, the measurement value of atmospheric pressure is corrected by adding 1 hPa to the value at step ST 710. Then the corrected atmospheric pressure value is indicated at step ST 711.

On the other hand, if it is judged at step ST 712 that the 10-o'clock button 13 (B switch) has been pressed, the measurement value of atmospheric pressure is corrected by subtracting 1 hPa from the value at step ST 713. Then the corrected atmospheric pressure value is indicated at step ST 711.

As was explained above, because the watch in this example has a calibration means to indicate an atmospheric pressure value as it is after atmospheric pressure is measured during the operation to be in a mode that can be calibrated, correct calibration can be carried out. Furthermore, because the watch in this example has an alarm producing means to produce an alarm which needs electricity after measuring atmospheric pressure, an error in measuring atmospheric pressure owing to voltage variation is small. Hence, high reliability of calibration.

Correction Operation to Indication of Atmospheric Pressure Variation Performed by Atmospheric Pressure Tendency Pointer One example of correction operation to exclude a rapid change in atmospheric pressure caused by transportation and so on which is carried out when the atmospheric pressure tendency pointer indicates atmospheric pressure variation will be described below with reference to FIG. 24.

In the correction method in this example, if atmospheric pressure changes more than a certain amount in a fixed time, that data is not employed and is supplemented with other data. In addition, if there are a number of data with great variation, a supplemental operation is not carried out.

For example, in comparing a differential in atmospheric pressure in three hours (unit period), basically a differential in atmospheric pressure measurement values is found every 30 minutes from three hours before to the present, and the sum of these six data of an atmospheric pressure differential is indicated as an atmospheric pressure differential every three hours. Here, of the data of an atmospheric pressure differential every 30 minutes, data more than 2 hPa are not adopted, and the variation amount of atmospheric pressure is found based on the sum of the remaining data. That is, the watch in this example has an abnormal data detection means which considers data with a value bigger than a fixed value as abnormal of a group of data to indicate a variation amount of environmental data every fixed time measured by a sensor in a fixed unit time, and has a data correction means which calculates as an indication content the content obtained by supplementing the variation amount of environmental data before and after the unit time passes based on the data obtained by excluding abnormal data from the group of data.

Of the data of an atmospheric pressure differential every 30 minutes, if there are more than five data of 2 hPa, the supplemental treatment is not carried out, and the sum of six data of an atmospheric pressure differential is adopted as an atmospheric pressure differential as it is.

Figure 24:
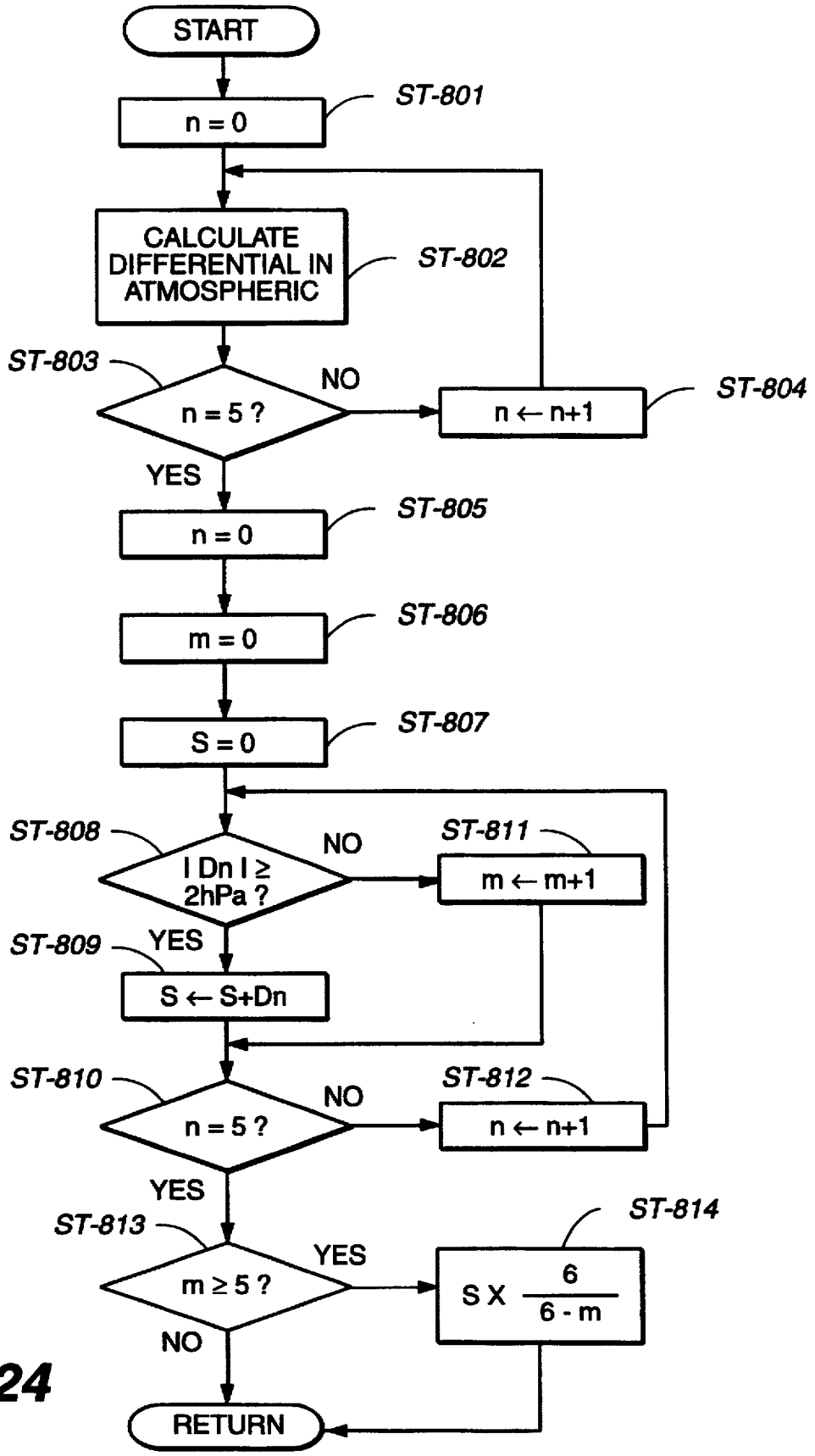
FIG. 24 is a flow chart illustrating a data correction operation in the multifunctional electronic watch of the second embodiment.

For the purpose of carrying out such an operation, in FIG. 24, at step ST 801 to step ST 804 a differential Dn between a measurement value of atmospheric pressure at one time and a measurement value of atmospheric pressure 30 minutes before this time is found successively.

Then at step ST 805 to step ST 807 a variable is initialized. At step ST 808 to step ST 812 it is judged whether an absolute value of the differential Dn of each atmospheric pressure every 30 minutes is more than 2 hPa or not, data with an variation amount of more than 2 hPa are discarded and the number m of the discarded data and the sum S of the remaining data are found.

Next, at step ST 813 it is judged whether the number m of the discarded data is five or more. If it is judged that the number m of the discarded data is less than five, the sum is multiplied by 6/(6−m), and the value obtained is indicated as an atmospheric pressure differential. On the other hand, if the number m of the discarded data is five or more, the sum of the six data of an atmospheric pressure differential is adopted as the atmospheric pressure differential as it is.

If such a correction method is employed, even if there is a great change in atmospheric pressure caused by moving between places of big difference in height, the data can be discarded.

Note that in FIG. 24 at step ST 814 the sum is multiplied by (6/6−m), but it is possible to use the sum S of effective data as it is when m is 1, to multiply the sum S of effective data by 1.5 when m is 2, and to multiply the sum S of effective data by 2 when m is 3 or 4. When the treatment is thus simplified, a binary operation is simplified, hence advantage in speeding up the indication and saving electricity.

Figure 25:
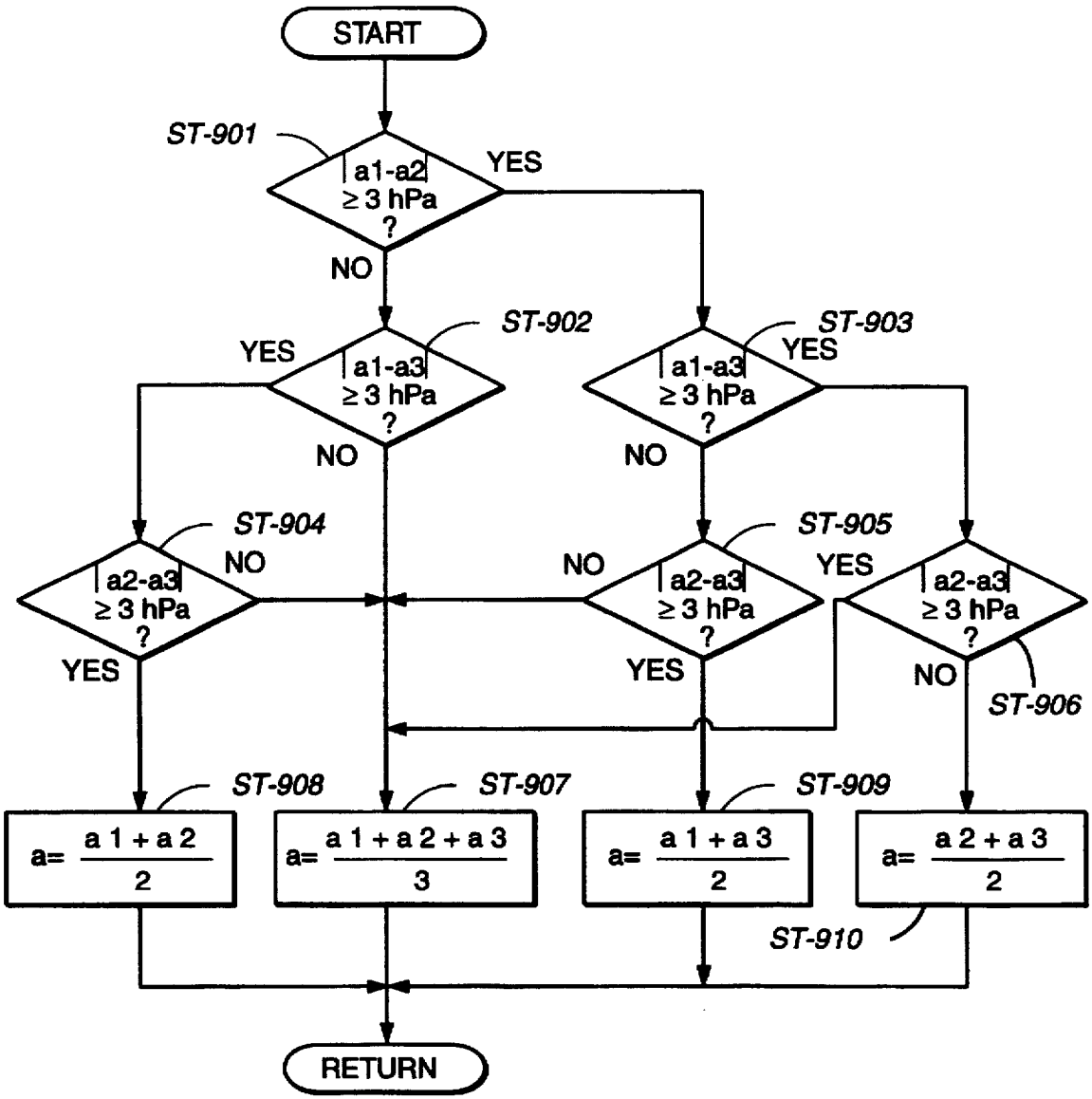
FIG. 25 is a flow chart illustrating another data correction operation.

As a correction method carried out in finding an atmospheric pressure differential, the method shown in FIG. 25 can be adopted.

In this method, in calculating an atmospheric pressure differential, not only is an atmospheric pressure differential between two places found, but also are data distant in time compared.

For instance, when an atmospheric pressure differential in three hours (unit time) is found, the unit time is divided in three parts by one hour, and an atmospheric pressure variation between 1 o'clock and 2 o'clock is calculated. In this calculation, basically the average value a of an atmospheric pressure measurement value at 0:40 (data a1), an atmospheric pressure measurement value at 0:50 (data a2) and an atmospheric pressure measurement value at 1:00 (data a3), and the average value b of an atmospheric pressure measurement value at 1:40 (data b1), an atmospheric pressure measurement value at 1:50 (data b2) and an atmospheric pressure measurement value at 2:00 (data b3) are found, and then the differential of the average value a and the average value b is found.

If the differential of the data a1 and the data a2 is a certain value or more, the differential of the data a1 and the data a3 is a certain value or more, and the differential of the data a2 and the data a3 is less than a certain value, the average value a is found from the data a2 and the data a3, and the data a1 is discarded as abnormal. And if more than a certain number of data are discarded, the average value a is found from the data a1, a2 and a3 without carrying out the correction.

In order to find the average value of each period as described above, in FIG. 25, at a step ST 901 it is judged whether the absolute value of the differential of the data a1 and a2 is 3 hPa or more. At a step ST 902 and a step ST 903 it is judged whether the absolute value of the differential of the data a1 and a3 is 3 hPa or more. At a step ST 904, a step ST 905 and a step ST 906 it is judged whether the absolute value of the differential of the data a2 and a3 is 3 hPa or more.

As a result, when it is judged at the step ST 901 that the absolute value of the differential of the data a1 and a2 is not 3 hPa or more, if it is judged at the step ST 902 that the absolute value of the differential of the data a1 and a3 is not 3 hPa or more, at a step ST 907 the average value a is found from the data a1, a2 and a3. That is, only the data used in the operation in which the absolute value of a differential is not judged to be 3 hPa or more are employed to obtain the average value a.

For example, even when it is judged at step ST 901 that the differential is 3 hPa or more, if it is judged at step ST 903 that the differential is not 3 hPa or more, and if it is judged at step ST 905 that the differential is not 3 hPa or more, the average value a is found from the data a1, a2 and a3 at step ST 907. That is, the correction treatment is not carried out.

And if it is judged that the differential is 3 hPa or more at each of step ST 901, step ST 903 and step ST 906, the average value a is found from the data a1, a2 and a3 at step ST 907. That is, the correction treatment is not carried out.

Of the three comparisons, if only at step ST 901 is it judged that the differential is not 3 hPa or more, and if at the other two steps it is judged that the differential is 3 hPa or more, at step ST 908 the average value a is found from the data a1 and a2 used in the judgment at step ST 901. Similarly, if only at step ST 905 is it judged that the differential is not 3 hPa or more, at step ST 909 the average value a is found from the data a1 and a3. And if only at step ST 906 is it judged that the differential is not 3 hPa or more, at step ST 910 the average value a is found from the data a2 and a3.

As was described above, because the watch in this example has an abnormal data detection means to detect the presence of abnormal data of the measurements of the sensor, and has a data correction means to operate the indication content based on the data obtained by excluding abnormal data from the measurements of the sensor making use of the detection result by the abnormal data detection means, an abnormal value is not indicated. Moreover, the abnormal data detection means regards a data with a differential bigger than a fixed set value compared with any other data as abnormal, of a group of data measured by the sensor every certain time in each period into which a fixed unit period is equally divided, and the data correction means calculates an average value from the data from which abnormal data are excluded in each equally divided period and then calculates as an indication content the variation amount of environmental data before and after the unit period passes based on the average values. Hence, high accuracy of the correction.

Note that it is possible to correct atmospheric pressure variation for a longer time based on the average value a found as described above. For instance, at step ST 802 in the flow chart shown in FIG. 24, the differential in an atmospheric pressure value Dn is found by comparing a certain measurement value and a measurement value three hours before. But instead of using a measurement value three hours before, it is possible to employ average values found in a treatment performed based on the flow chart in FIG. 25 and to check whether each of the average values is abnormal or not in order to find a variation amount of atmospheric pressure every unit time.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An electronic watch comprising:

a watch body having an upper surface, a lower surface, a side surface;

a sensor for measuring environmental data, wherein said sensor comprises a measurement surface;

an environmental data indication means for indicating the environmental data measured by said sensor comprising an environmental data indication pointer arranged towards the upper surface for indicating the environmental data;

time indication means for indicating time comprising a movement;

a controller for controlling said environmental data and said time indication means;

a power source for said sensor, said environmental data indication means; said time indication means, and said controller;

wherein said controller is arranged in a non-overlapping manner with respect to said sensor and said power source when viewed in a direction substantially perpendicular to the upper surface of said watch body;

wherein said sensor is arranged in a non-overlapping manner with respect to said power source when viewed in a direction substantially perpendicular to the upper surface of said watch body;

wherein said measurement surface faces one of said upper surface and said lower surface of said watch body;

wherein said watch body comprises;

a base frame in which said sensor, said environmental data indication means, and said time indications means are mounted; and a cover case to enclose said sensor, said environmental data indication means, and said time indication means, said base frame comprising, on a side of said base frame:

a sensor containment portion for housing said sensor having an inside area, a first gasket means to secure waterproofness between the inside area of said sensor containment portion and said sensor, and a first through hole formed in a raised portion of said base frame and leading from an end of said raised portion to said sensor containment portion, and comprises, on the side of said cover case, a concave portion for receiving said raised portion, a second gasket means for securing waterproofness between said concave portion and said raised portion, and a second through hole which connects a sensing face of said sensor with the outside of said cover case by being in communication to said first through hole having said raised portion housed in said concave portion.

2. An electronic watch according to claim 1, wherein said sensor intermittently measures the environmental data during a measurement period and inhibits measurement during a pause period.

3. An electronic watch according to claim 1, wherein said time indication means further comprises a pointer movement changeover means to change a manner of moving said time indication pointer between the measurement period and the pause period of the environmental data measurement by said sensor.

4. An electric watch comprising:

a face;

a power source;

a watch body having an upper surface, a lower surface, a side surface;

a sensor for measuring environmental data during a measurement period, wherein said sensor comprises a measurement surface which faces one of said upper surface and said lower surface of said watch body, wherein said sensor is inhibited from measuring environmental data during a pause period;

time indication means for indicating time comprising a movement, wherein said movement comprises a stepping motor;

a drive motor;

environmental data indication means for indicating the environmental data measured by said sensor comprising said environmental data indication pointer arranged towards the upper surface for indicating the environmental data, wherein said environmental data indication means is in communication with said drive motor, wherein said environmental data indication means indicating the environmental data by rotating said environmental data indication pointer to a fixed position in one of a first direction and a second direction by said drive motor;

wherein said environmental data indication means indication means further comprises a first wheel train in communication with said environmental data indication pointer having a gear with a tooth portion formed only in a part of an outer periphery so that an area of said gear in which no tooth is formed determines a rotational angle range of said environmental data indication pointer;

controller for controlling said environmental data indication means and said time indication means, wherein said controller is arranged in a non-overlapping manner with respect to said sensor and said power source when viewed in a direction substantially perpendicular to the upper surface of said watch body;

wherein said power source supplies power to said sensor, said environmental data indication means and said time indication means, wherein said sensor is arranged in a non-overlapping manner with respect to the said power source when viewed in a direction substantially perpendicular to the upper surface of said watch body;

a first pointer for pointing to a first indication unit;

a second pointer for pointing to a second indication unit;

wherein said drive motor rotationally drives said first and second pointers through a second wheel train, wherein said first pointer which rotates has a first angular range of 360 degrees, wherein said second pointer rotates around a center of said face, wherein said second pointer has a second angle range which is less than said first angular range of said first pointer;

pointer movement changeover means to change a manner of moving said time indication pointer between said measurement period and said pause period of the environmental data measurement by said sensor, calibration means for calibrating said electronic watch in accordance with a difference between the environmental data measured by said sensor and the environmental data indicated by said environmental indication means, wherein said calibration means controls said sensor to measure environmental data so as to operate in a calibration mode, and controls said environmental data indication means for indicating the environmental data measured by said sensor;

wherein said environmental data indication means further comprises backlash prevention means for moving said environmental data indication pointer in a larger number of steps to the fixed position in said first direction than a number of steps when a rotational direction of said environmental data pointer is changed to a second direction, abnormal data detection means for detecting abnormal data from said sensor, and data correction means for controlling said environmental data indication means in accordance with said abnormal data detection means by excluding abnormal data from the measurements of said sensor.

* * * * *

UNITED STATES PATENT AND TRADEMARK OFFICE

CERTIFICATE OF CORRECTION

| | | |
|---|---|---|
| PATENT NO. | : | 5,802,016 |
| DATED | : | September 01, 1998 |
| INVENTOR(S) | : | Masaru Kubota, et al. |

It is certified that an error appears in the above identified patent and that said Letters Patent is hereby corrected as shown below:

Title page, item [30], Foreign Application Priority Data, please insert:
--Jun. 28, 1994 Japan 146099--.

Signed and Sealed this

Fourth Day of May, 1999

*Attest:*

Q. TODD DICKINSON

*Attesting Officer*

*Acting Commissioner of Patents and Trademarks*